US010780605B2

(12) United States Patent
Schrul et al.

(10) Patent No.: US 10,780,605 B2
(45) Date of Patent: Sep. 22, 2020

(54) CALCIUM CARBONATE FOR PARTICLE BOARDS

(71) Applicant: Omya International AG, Oftringen (CH)

(72) Inventors: Christopher Schrul, Aarburg (CH); Johannes Kritzinger, Olten (CH); Tomasz Ozyhar, Zürich (CH); Philipp Hunziker, Loveland, OH (US)

(73) Assignee: Omya International AG, Oftringen (CH)

( * ) Notice: Subject to any disclaimer, the term of this patent is extended or adjusted under 35 U.S.C. 154(b) by 141 days.

(21) Appl. No.: 15/774,524

(22) PCT Filed: Nov. 24, 2016

(86) PCT No.: PCT/EP2016/078716
§ 371 (c)(1),
(2) Date: May 8, 2018

(87) PCT Pub. No.: WO2017/093122
PCT Pub. Date: Jun. 8, 2017

(65) Prior Publication Data

US 2020/0016788 A1 Jan. 16, 2020

Related U.S. Application Data

(60) Provisional application No. 62/263,777, filed on Dec. 7, 2015.

(30) Foreign Application Priority Data

Nov. 30, 2015 (EP) ..... 15196997

(51) Int. Cl.
*B27N 1/02* (2006.01)
*B27N 3/02* (2006.01)

(52) U.S. Cl.
CPC ..... *B27N 3/02* (2013.01); *B27N 1/02* (2013.01)

(58) Field of Classification Search
None
See application file for complete search history.

(56) References Cited

U.S. PATENT DOCUMENTS

| | | | | |
|---|---|---|---|---|
| 5,422,170 | A | 6/1995 | Iwata et al. | |
| 5,705,001 | A | 1/1998 | Iwata et al. | |
| 2002/0139082 | A1* | 10/2002 | DeFord | E04C 2/04 52/783.1 |
| 2004/0258898 | A1 | 12/2004 | Hume | |
| 2011/0135907 | A1 | 6/2011 | Shooshtari et al. | |
| 2014/0370319 | A1 | 12/2014 | Vetter et al. | |

FOREIGN PATENT DOCUMENTS

| | | | |
|---|---|---|---|
| CN | 102862206 | B | 7/2015 |
| DE | 1310191 | A1 | 10/1993 |
| DE | 102006024593 | A1 | 12/2007 |
| EP | 0094922 | A1 | 11/1983 |
| EP | 2944621 | A1 | 11/2015 |
| WO | 2006042651 | A1 | 4/2006 |
| WO | 2008038869 | A1 | 4/2008 |

OTHER PUBLICATIONS

The International Search Report dated Jun. 8, 2017 from PCT/EP2016/078716.
The Written Opinion of the International Searching Authority dated Jun. 8, 2017 from PCT/EP2016/078716.

* cited by examiner

*Primary Examiner* — Sheeba Ahmed
(74) *Attorney, Agent, or Firm* — Heslin Rothenberg Farley & Mesiti, P.C.

(57) ABSTRACT

The present invention relates to a particle board, a process for manufacturing the particle board as well as the use of at least one particulate calcium carbonate-containing material as wood particle replacement in a particle board.

19 Claims, 5 Drawing Sheets

CALCIUM CARBONATE FOR PARTICLE BOARDS

CROSS-REFERENCE TO RELATED APPLICATIONS

This is a U.S. national phase of PCT Application No. PCT/EP2016/078716, filed Nov. 24, 2016, which claims priority to U.S. Provisional Appln. No. 62/263,777, filed Dec. 7, 2015 and European Application No. 15196997.9, filed Nov. 30, 2015.

The present invention relates to a particle board, a process for manufacturing the particle board as well as the use of at least one particulate calcium carbonate-containing material as wood particle replacement in a particle board.

Particle boards are widely used for indoor applications such as in furniture, flooring, houses, stair treads and underlayments or paneling substrates due to their reasonable costs, wide range and flexibility of application, and easiness of finishing. Such particle boards are composite products comprising mainly wood particles which are joined together, with or without using binder, under heat and pressure. Such boards and methods for preparing same are described in a number of documents. For instance, WO 2006/042651 A1 refers to light-coloured to white wooden material panels being produced from bleached wood fibres and/or vat-dyed with a white pigment. DE 43 10 191 A1 relates to wood-based panel boards including inorganic cellular materials and flame retardant. The inorganic cellular material comprises a cellular material made from inorganic materials. For example, these may be materials having an inorganic oxide such as silicon oxide or aluminium oxide as the principle component, with a granular structure filled with minute closed cells. U.S. Pat. Nos. 5,422,170 A and 5,705,001 A refer to wood based panels for which wood fibre, inorganic cellular material, flame retardant and an organic binder for binding these materials, are mixed together and hot press formed to give the wood based panel. US 2004/0258898 A1 relates to a method for fabricating fire retardant composite panels comprising: creating a water-based slurry of partially soluble boron salts; adding an adhesive to a ligneous material; and independently introducing said water-based slurry to said igneous material for fire retarding thereof.

Even though a great variety of particle boards is already available on the market having tailored properties including strength, elastic properties, and further processability, a general disadvantage of said wood particle boards is that the main constituent, i.e. the wood particles, is based on organic renewable resources which is subject to decreasing availability at increasing prices due to an increasing demand from the biomass energy sector.

Therefore, there is a continuous need in the art for particle boards in which at least a part of the raw material being based on organic renewable resources is replaced by an alternative material while important mechanical properties such as bending strength and modulus of elasticity, internal bond strength, thickness swelling, elastic properties and further processability are maintained or even improved. In addition thereto, it is desired to decrease the overall weight of the particles boards without deterioration of the above mechanical properties.

Accordingly, it is an objective of the present invention to provide a particle board in which at least a part of the raw material being based on organic renewable resources is replaced by an alternative material. A further objective is to provide a particle board in which the set of other important mechanical properties such as bending strength and modulus of elasticity, internal bond strength, thickness swelling, elastic properties and further processability is maintained or even improved, preferably with respect to the international DIN standards. Another object is to provide a particle board having a decreased overall weight.

The foregoing and other objectives are solved by the subject-matter as defined herein in claim 1.

Advantageous embodiments of the inventive particle board are defined in the corresponding sub-claims.

According to one aspect of the present application a particle board is provided. The particle board comprising a) a wood particle base layer having a first side and a reverse side, the wood particle base layer comprising
   i) wood particles in an amount from 60.0 to 97.5 parts by weight (d/d) and at least one particulate calcium carbonate-containing material in an amount from 2.5 to 40.0 parts by weight (d/d), based on the total dry weight of the wood particles and at least one particulate calcium carbonate-containing material of the wood particle base layer, and b) at least one wood particle surface layer being in contact with the first and/or reverse side of the wood particle base layer, the at least one wood particle surface layer comprising
   ii) wood particles in an amount from 70.0 to 97.5 parts by weight (d/d) and at least one particulate calcium carbonate-containing material in an amount from 2.5 to 30.0 parts by weight (d/d), based on the total dry weight of the wood particles and the at least one particulate calcium carbonate-containing material of the at least one wood particle surface layer, wherein the sum of the amount of the wood particles and the at least one particulate calcium carbonate-containing material in each of the wood particle base layer and the at least one wood particle surface layer is 100.0 parts by weight (d/d), based on the total dry weight of the wood particles and the at least one particulate calcium carbonate-containing material in the layer.

Figure 1:
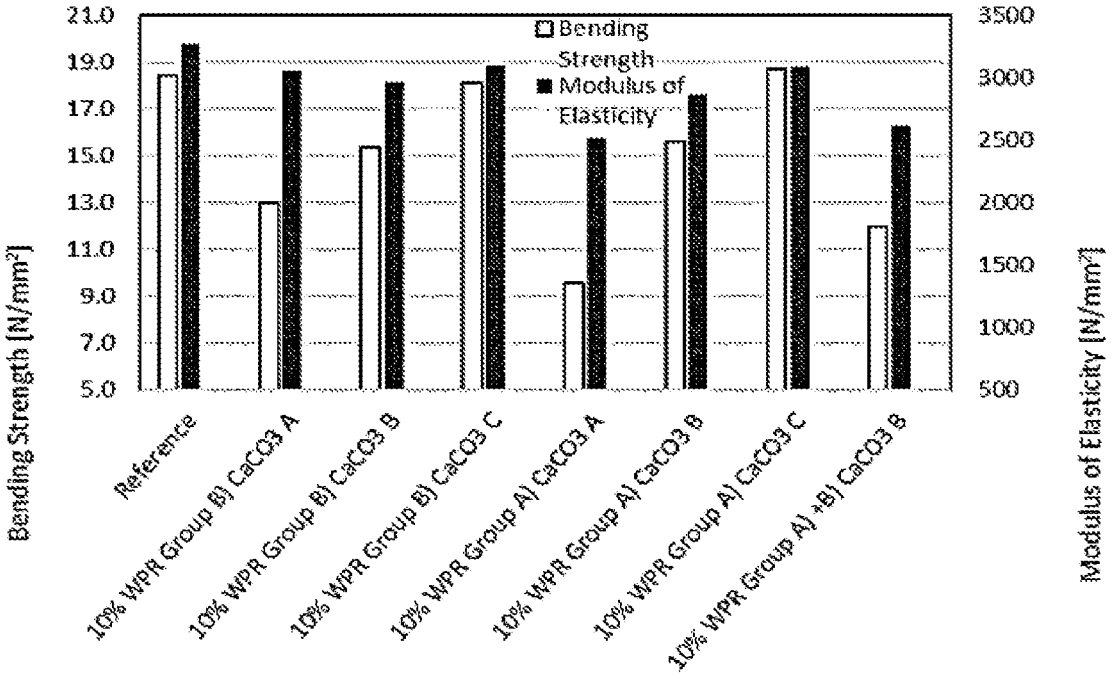
FIG. 1 shows the bending strength and modulus of elasticity of particle boards in accordance with the invention, in comparison to a reference particle board.
Figure 2:
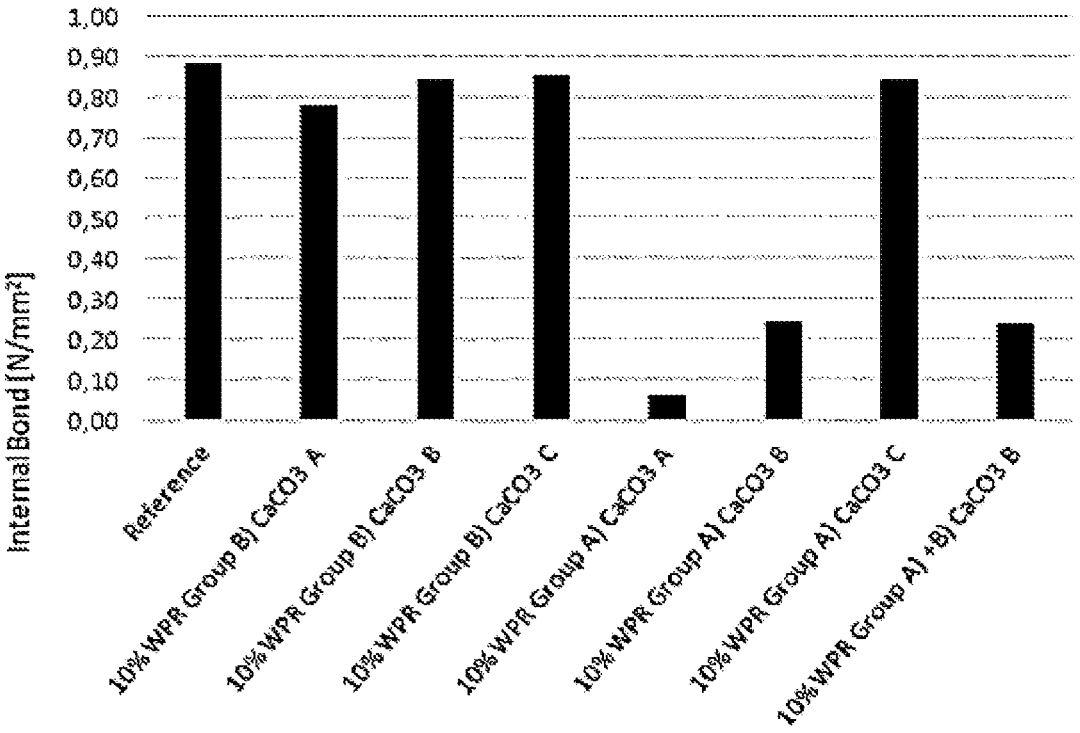
FIG. 2 shows the internal bond strength of particle boards in accordance with the invention, in comparison to a reference particle board.
Figure 3:
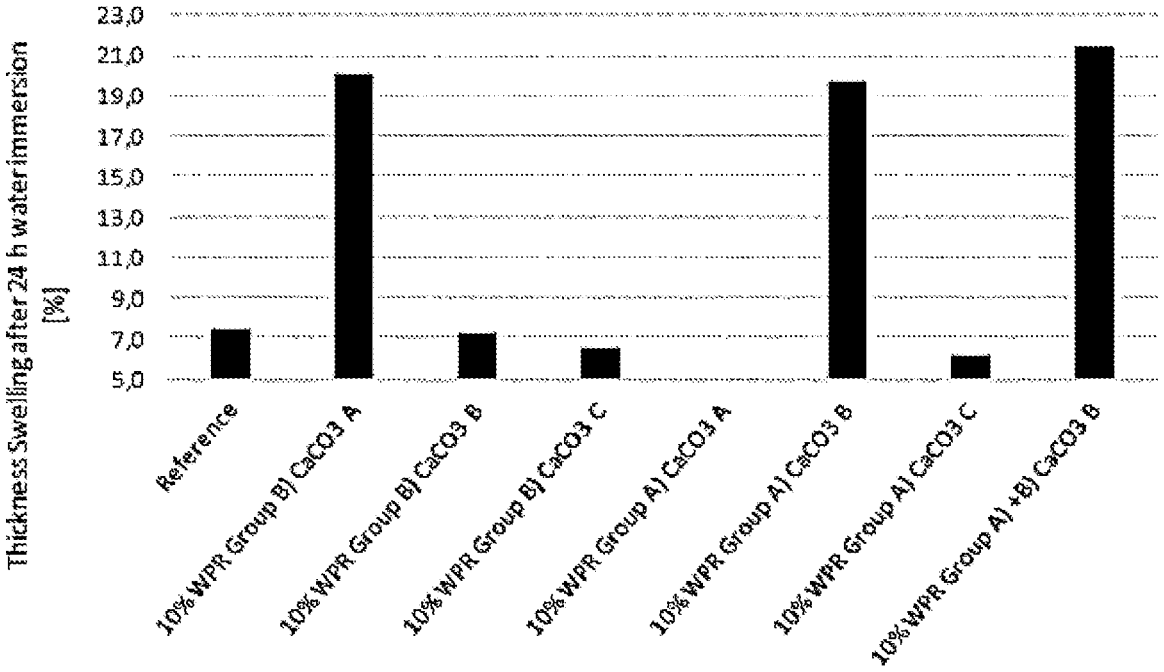
FIG. 3 shows the thickness swelling of particle boards in accordance with the invention, in comparison to a reference particle board.
Figure 4:
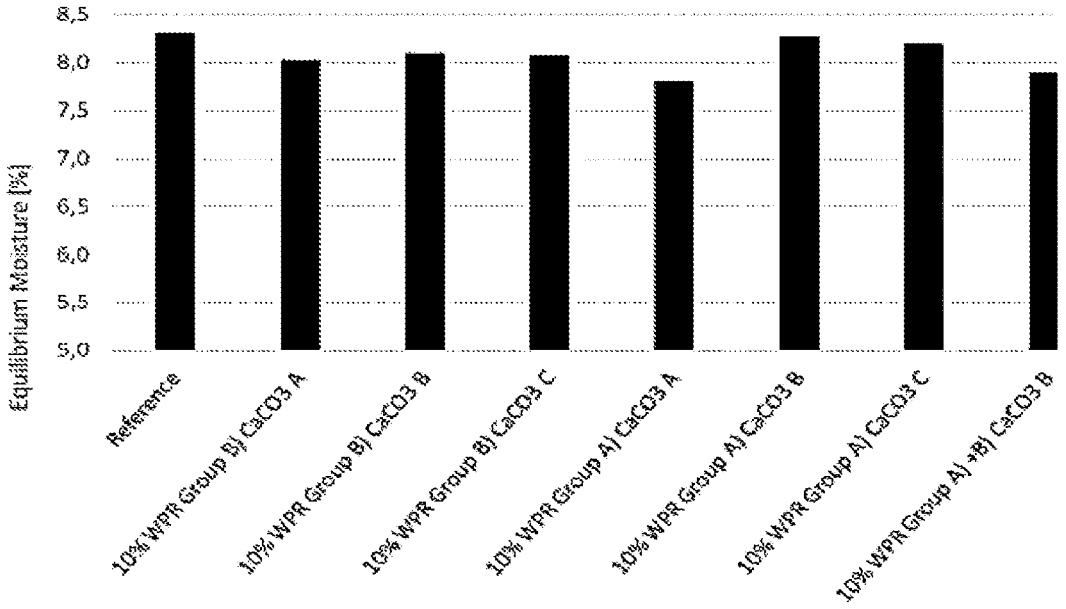
FIG. 4 shows the wood moisture content of particle boards in accordance with the invention, in comparison to a reference particle board.

It should be understood that for the purposes of the present invention, the following terms have the following meanings:

The term "calcium carbonate-containing material" refers to a material that comprises at least 10.0 wt.-% calcium carbonate, based on the total dry weight of the calcium carbonate-containing material.

For the purpose of the present invention, the weight median particle diameter "$d_{50}$" represents the diameter relative to which x % by weight of the particles have diameters less than $d_x$. This means that the $d_{20}$ value is the particle size at which 20.0 wt.-% of all particles are smaller, and the $d_{80}$ value is the particle size at which 80.0 wt.-% of all particles are smaller. The $d_{50}$ value is thus the weight median particle size, i.e. 50.0 wt.-% of all grains are smaller than this particle size. For the purpose of the present invention the particle size is specified as weight median particle size $d_{50}$ unless indicated otherwise. The weight median particle diameter of the at least one particulate calcium carbonate-containing material was measured by laser diffraction. In this method, the particle size is determined by measuring the intensity of light scattered as a laser beam passes through a dispersed particulate sample. The measurement is made with a Mastersizer 2000 or a Mastersizer 3000 of Malvern Instruments Ltd. (operating instrument software version 1.04).

The term "d/d" in the meaning of the present invention refers to the dry amount based on the dry amount of the defined solid material.

Where the term "comprising" is used in the present description and claims, it does not exclude other non-specified elements of major or minor functional importance. For the purposes of the present invention, the term "consisting of" is considered to be a preferred embodiment of the term "comprising of". If hereinafter a group is defined to comprise at least a certain number of embodiments, this is also to be understood to disclose a group, which preferably consists only of these embodiments.

Whenever the terms "including" or "having" are used, these terms are meant to be equivalent to "comprising" as defined above.

Where an indefinite or definite article is used when referring to a singular noun, e.g. "a", "an" or "the", this includes a plural of that noun unless something else is specifically stated.

Terms like "obtainable" or "definable" and "obtained" or "defined" are used interchangeably. This e.g. means that, unless the context clearly dictates otherwise, the term "obtained" does not mean to indicate that e.g. an embodiment must be obtained by e.g. the sequence of steps following the term "obtained" even though such a limited understanding is always included by the terms "obtained" or "defined" as a preferred embodiment.

According to another aspect of the present invention, a process for manufacturing a particle board as defined herein is provided. The process comprising the steps of:

a) providing wood particles, as defined herein, in dry form,
b) providing at least one particulate calcium carbonate-containing material as defined herein,
c) optionally providing at least one binder as defined herein and/or at least one compound as defined herein,
d) combining the wood particles of step a) simultaneously or separately in any order with the at least one particulate calcium carbonate-containing material of step b) and the optional at least one binder and/or at least one compound of step c) to form a wood particle-calcium carbonate-containing material mixture which is suitable to form a wood particle base layer mat,
e) combining the wood particles of step a) simultaneously or separately in any order with the at least one particulate calcium carbonate-containing material of step b) and the optional at least one binder and/or at least one compound of step c) to form a wood particle-calcium carbonate-containing material mixture which is suitable to form at least one wood particle surface layer mat,
f) forming a multi-layer mat of the wood particle-calcium carbonate-containing material mixtures obtained in steps d) and e), and
g) pressing the multi-layer mat of step f) in one or more steps into a solid particle board.

According to one embodiment of the process, process steps d) and/or e) is/are carried out in that the wood particles of step a) are combined simultaneously with the at least one particulate calcium carbonate-containing material of step b) and the optional at least one binder and/or at least one compound of step c), or process steps d) and/or e) is/are carried out in that the wood particles of step a) are combined separately with the at least one particulate calcium carbonate-containing material of step b) and the optional at least one binder and/or at least one compound of step c). According to another embodiment of the process, the wood particles of step a) and/or the at least one particulate calcium carbonate-containing material of step b) is/are provided in dry form.

According to a further aspect of the present invention, the use of at least one particulate calcium carbonate-containing material as wood particle replacement in a particle board is provided. Preferably the at least one particulate calcium carbonate-containing material has a weight median particle size $d_{50}$ from 1.0 μm to 1 000.0 μm, more preferably from 15.0 μm to 1 000.0 μm and most preferably from 30.0 μm to 1 000.0 μm.

According to one embodiment of the present invention, the at least one particulate calcium carbonate-containing material is dolomite and/or at least one ground calcium carbonate (GCC), such as marble, chalk, limestone and/or mixtures thereof, and/or at least one precipitated calcium carbonate (PCC), preferably at least one ground calcium carbonate (GCC).

According to another embodiment of the present invention, the at least one particulate calcium carbonate-containing material of the wood particle base layer and/or the at least one wood particle surface layer has a) a weight median particle size $d_{50}$ from 1.0 μm to 1 000.0 μm, more preferably from 15.0 μm to 1 000.0 μm and most preferably from 30.0 μm to 1 000.0 μm, and/or b) a specific surface area of ≤5.0 $m^2/g$, more preferably from 0.1 to 5.0 $m^2/g$ and most preferably of from 0.2 to 1.0 $m^2/g$ as measured by the BET nitrogen method, and/or c) a top cut $d_{98}$ from 100.0 to 1 200.0 μm, more preferably from 250.0 μm to 1 100.0 μm and most preferably from 500.0 μm to 1 000.0 μm.

According to yet another embodiment of the present invention, the at least one particulate calcium carbonate-containing material of the wood particle base layer and/or the at least one wood particle surface layer consists of calcium carbonate in an amount of ≥10.0 wt.-%, preferably of 20.0 wt.-%, more preferably of 50.0 wt.-%, even more preferably of 90.0 wt.-%, more preferably of ≥95.0 wt.-% and most preferably of ≥97.0 wt.-%, based on the total dry weight of the calcium carbonate-containing material.

According to one embodiment of the present invention, the wood particles of the wood particle base layer and the at least one wood particle surface layer originate from primary wood sources, such as softwood tree species, hardwood tree species, non-wood fibre plants, or secondary wood sources, such as recycled wood, and mixtures thereof.

According to another embodiment of the present invention, the wood particle base layer comprises the wood particles in an amount from 70.0 to 95.0 parts by weight (d/d) and the at least one particulate calcium carbonate-containing material in an amount from 5.0 to 30.0 parts by weight (d/d), based on the total dry weight of the wood particles and the at least one particulate calcium carbonate-containing material of the wood particle base layer, and/or the at least one wood particle surface layer comprises the wood particles in an amount from 75.0 to 95.0 parts by weight (d/d) and at least one particulate calcium carbonate-containing material in an amount from 5.0 to 25.0 parts by weight (d/d), based on the total dry weight of the wood particles and the at least one particulate calcium carbonate-containing material of the at least one wood particle surface layer.

According to yet another embodiment of the present invention, the wood particles of the wood particle base layer and of the at least one wood particle surface layer are the same or different; and/or the at least one particulate calcium carbonate-containing material of the wood particle base layer and of the at least one wood particle surface layer are the same or different, preferably the at least one particulate calcium carbonate-containing material of the wood particle base layer and of the at least one wood particle surface layer differ in their weight median particle size $d_{50}$.

According to one embodiment of the present invention, the wood particle base layer and/or the at least one wood particle surface layer comprise(s) at least one binder in an amount from 0.05 to 25.0 parts by weight (d/d), based on the total dry weight of the wood particles and the at least one particulate calcium carbonate-containing material, preferably the at least one binder is selected from the group comprising phenol-formaldehyde resin (PF), urea-formaldehyde resin (UF), melamine-formaldehyde resin (MF), melamine-urea-formaldehyde resin (MUF), urea-melamine-formaldehyde resin (UMF), urea-melamine-phenol-formaldehyde resin (UMPF), epoxy resin, methylene diphenyl diisocyanate resin (MDI), polyurethane resin (PU), resorcin resin, starch or carboxymethylcellulose and mixtures thereof, more preferably the at least one binder is selected from the group comprising phenol-formaldehyde resin (PF), urea-formaldehyde resin (UF), melamine-formaldehyde resin (MF), melamine-urea-formaldehyde resin (MUF), urea-melamine-formaldehyde resin (UMF), urea-melamine-phenol-formaldehyde resin (UMPF), epoxy resin, methylene diphenyl diisocyanate resin (MDI), polyurethane resin (PU) and mixtures thereof.

According to another embodiment of the present invention, the wood particle base layer and/or the at least one wood particle surface layer further comprises at least one compound selected from the group comprising waxes, colorants, filler (differing from the at least one particulate calcium carbonate-containing material), dispersants, biocides, hardener and flame retardants.

According to yet another embodiment of the present invention, the particle board is a three-layer particle board consisting of the wood particle base layer and two wood particle surface layers, preferably one wood particle surface layer is in contact with the first side of the wood particle base layer and the other wood particle surface layer is in contact with the reverse side of the wood particle base layer.

According to one embodiment of the present invention, the particle board has a bending strength of ≥10 N/mm$^2$, preferably from 10 to 25 N/mm$^2$ and most preferably from 10 to 20 N/mm$^2$; and/or a modulus of elasticity of ≥1 000 N/mm$^2$, preferably from 1 600 to 3 500 N/mm$^2$ and most preferably from 1 600 to 3 200 N/mm$^2$; and/or internal bond strength of ≥0.30 N/mm$^2$, more preferably from 0.35 to 1.0 N/mm$^2$ and most preferably from 0.35 to 0.9 N/mm$^2$; and/or a thickness swelling after 24 h water storage of ≤15%, more preferably from 4.0 to 15.0% and most preferably from 5.0 to 14%.

As set out above, the inventive particle board comprises a wood particle base layer comprising wood particles and at least one particulate calcium carbonate-containing material as well as at least one wood particle surface layer comprising wood particles and at least one particulate calcium carbonate-containing material as set out in points a), i), b) and ii). In the following, it is referred to further details of the present invention and especially the foregoing points of the inventive particle board.

The inventive particle board comprises a wood particle base layer having a first side and a reverse side. The wood particle base layer serves as a support for the at least one wood particle surface layer. Thus, the particle board preferably comprises, more preferably consists of, a wood particle base layer having a first side and a reverse side and at least one wood particle surface layer being in contact with the first and/or reverse side of the wood particle base layer.

It is appreciated that it is especially advantageous with regard to the mechanical properties such as bending strength and modulus of elasticity, internal bond strength, thickness swelling, elastic properties and further processability, if the particle board preferably comprises, more preferably consists of, a wood particle base layer having a first side and a reverse side and at least one wood particle surface layer being in contact with the first and reverse side of the wood particle base layer.

Thus, the inventive particle board is preferably a multilayer particle board, such as a three-layer or five-layer particle board, consisting of the wood particle base layer and two or four wood particle surface layers. For example, the particle board is a three-layer particle board consisting of the wood particle base layer and two wood particle surface layers, wherein one wood particle surface layer is in contact with the first side of the wood particle base layer and the other wood particle surface layer is in contact with the reverse side of the wood particle base layer.

As already mentioned above, the particle board according to the present invention specifically features high mechanical properties such as bending strength and modulus of elasticity, internal bond strength, thickness swelling, elastic properties and further processability.

The inventive particle board specifically features a high bending strength. Preferably, the particle board has a bending strength of ≥10 N/mm$^2$, preferably from 10 to 25 N/mm$^2$ and most preferably from 10 to 20 N/mm$^2$. Unless indicated otherwise, the bending strength is determined according to DIN EN 310.

Additionally or alternatively, the inventive particle board features a high modulus of elasticity. Preferably, the particle board has a modulus of elasticity of ≥1 000 N/mm$^2$, preferably from 1 600 to 3 500 N/mm$^2$ and most preferably from 1 600 to 3 200 N/mm$^2$. Unless indicated otherwise, the modulus of elasticity is determined according to DIN EN 310.

Additionally or alternatively, the inventive particle board features a high internal bond strength. Preferably, the particle board has an internal bond strength of ≥0.30 N/mm$^2$, more preferably from 0.35 to 1.0 N/mm$^2$ and most preferably from 0.35 to 0.9 N/mm$^2$. Unless indicated otherwise, the internal bond strength is determined according to DIN EN 319. It is appreciated that the internal bond strength may be also named as transverse tensile strength.

Additionally or alternatively, the inventive particle board features a high thickness swelling. Preferably, the particle board has a thickness swelling after 24 h water storage of ≤15%, more preferably from 4.0 to 15.0% and most preferably from 5.0 to 14%. Unless indicated otherwise, the thickness swelling is determined according to DIN EN 317.

For example, the inventive particle board has a bending strength of ≥10 N/mm$^2$, preferably from 10 to 25 N/mm$^2$ and most preferably from 10 to 20 N/mm$^2$; or a modulus of elasticity of ≥1 000 N/mm$^2$, preferably from 1 600 to 3 500 N/mm$^2$ and most preferably from 1 600 to 3 200 N/mm$^2$; or internal bond strength of ≥0.30 N/mm$^2$, more preferably from 0.35 to 1.0 N/mm$^2$ and most preferably from 0.35 to 0.9 N/mm$^2$; or a thickness swelling after 24 h water storage of ≤15%, more preferably from 4.0 to 15.0% and most preferably from 5.0 to 14%.

Alternatively, the particle board has a bending strength of ≥10 N/mm$^2$, preferably from 10 to 25 N/mm$^2$ and most preferably from 10 to 20 N/mm$^2$; and a modulus of elasticity of ≥1 000 N/mm$^2$, preferably from 1 600 to 3 500 N/mm$^2$ and most preferably from 1 600 to 3 200 N/mm$^2$; and internal bond strength of ≥0.30 N/mm$^2$, more preferably from 0.35 to 1.0 N/mm$^2$ and most preferably from 0.35 to 0.9 N/mm$^2$; and a thickness swelling after 24 h water storage of ≤15%, more preferably from 4.0 to 15.0% and most preferably from 5.0 to 14%.

In one embodiment, the particle board of the present invention has an equilibrium moisture of ≤8%, preferably of ≤7.8%, more preferably of ≤7.5%, even more preferably of ≤7.0%, even further more preferably of ≤6.8%, and most preferably of ≤6.5%, e.g. in the range from 5.0 to 6.5%. Unless indicated otherwise, the equilibrium moisture is determined according to DIN EN 322.

For example, the equilibrium moisture of the inventive particle board is preferably 5%, more preferably 10%, even more preferably 15%, still more preferably 20% and most preferably 25% below the equilibrium moisture of a particle board being prepared without the at least one particulate calcium carbonate-containing material in the wood particle base layer and/or the at least one wood particle surface layer.

It is appreciated that decreasing the equilibrium moisture results in a reduced weight of the overall particle board.

In one embodiment, the particle board of the present invention has a thickness from 0.2 to 300.0 mm, preferably from 2.0 to 40.0 mm and most preferably from 4.0 to 20 mm.

For example, the wood particle base layer and the at least one wood particle surface layer are present in about equal thicknesses, i.e. the thickness of the wood particle base layer and the sum of thicknesses of each of the wood particle surface layer present is about the same. If the particle board comprises two or more wood particle surface layers the thickness of each wood particle surface layer is preferably about the same. For example, if the particle board is a three-layer particle board, each wood particle surface layer is about half the thickness of the wood particle base layer.

Preferably, the wood particle base layer of the present particle board has a thickness from 0.1 to 150.0 mm, preferably from 1.0 to 20.0 mm and most preferably from 2.0 to 10 mm. Additionally or alternatively, the at least one wood particle surface layer of the present particle board has in total a thickness from 0.1 to 150.0 mm, preferably from 1.0 to 20.0 mm and most preferably from 2.0 to 10 mm.

In one embodiment of the present invention, the particle board has a density from 100 to 1 200 kg/m$^3$, preferably from 200 to 1 100 kg/m$^3$ and most preferably from 300 to 1 000 kg/m$^3$ and a thickness from 1.0 to 300.0 mm, preferably from 2.0 to 40.0 mm and most preferably from 4.0 to 20 mm. Unless indicated otherwise, the density is determined according to DIN EN 323.

Thus, the particle board of the present invention may be selected from high-density particle board, medium-density particle board and low-density fibre particle board. For example, the particle board of the present invention may be a particle board of the grade LD-1, LD-2, M-1, M-S, M-2, M-3, H-1, H-2 and/or H-3 as defined in John A. Youngquist, Wood-based composites and panel products; Wood handbook: wood as an engineering material. Madison, Wis.: USDA Forest Service, Forest Products Laboratory, 1999. General technical report FPL; GTR-113: Pages 10.1-10.31 or a particle board of the grade P1, P2, P3, P4, P5, P6 and/or P7 as defined in DIN EN 312:2010-12; pages 120-127.

Wood Particle Base Layer

According to point a) of the present invention, the particle board comprises a wood particle base layer having a first side and a reverse side, the wood particle base layer comprises wood particles in an amount from 60.0 to 97.5 parts by weight (d/d) and at least one particulate calcium carbonate-containing material in an amount from 2.5 to 40.0 parts by weight (d/d), based on the total dry weight of the wood particles and at least one particulate calcium carbonate-containing material of the wood particle base layer.

It is appreciated that the wood particle base layer of the particle board may comprise one or more kinds of wood particles.

Accordingly, the wood particle base layer may comprise one kind of wood particles. Alternatively, the wood particle base layer may comprise a mixture of two or more kinds of wood particles. For example, the wood particle base layer may comprise a mixture of two or three kinds of wood particles. Preferably, the wood particle base layer comprises one kind of wood particles.

It is appreciated that the wood particles present in the wood particle base layer according to the present invention are not restricted to specific wood particles as long as they are suitable for the preparation of a wood particle base layer of a particle board.

Preferably, the wood particles are wood-based or fibrous-based particles. The term "wood-based" particles in the meaning of the present invention refers to the common definition, i.e. wood is the fibrous, hard substance making up most of the tree trunk and branches of softwood and hardwood tree species. The term "fibrous-based" particles in the meaning of the present invention refers to any fibrous material which is not derived from wood, i.e. fibrous-based is the fibrous substance making up most of the plants.

Such wood-based or fibrous-based particles can be any wood-based or fibrous-based particles well known to the skilled person and typically used in particle boards. For example, the wood particles originate from primary wood sources such as softwood tree species, hardwood tree species, non-wood fibre plants and mixtures thereof. Additionally or alternatively, the wood particles originate from secondary wood sources such as recycled wood.

The wood particle base layer preferably comprises wood particles of specific dimensions. For example, the wood particle base layer comprises wood particles having i) a particle length in the range from 0.4 to 15 mm, more preferably from 3 to 15 mm and most preferably from 5 to 15 mm, and/or ii) a particle thickness in the range from 0.1 to 2.0 mm, more preferably from 0.2 to 1.5 mm and most preferably from 0.25 to 1.0 mm, and/or iii) a ratio of particle length to particle thickness of from 2 to 60, more preferably from 5 to 60 and most preferably from 10 to 60.

It is appreciated that the particle "length" refers to the longest dimension of the wood particles. The term particle "thickness" refers to the shortest dimension of the wood particles. It is appreciated that the length or thickness refers to the average length or average thickness.

Preferably, the wood particle base layer comprises wood particles having i) a particle length in the range from 0.4 to 15 mm, more preferably from 3 to 15 mm and most preferably from 5 to 15 mm, or ii) a particle thickness in the range from 0.1 to 2.0 mm, more preferably from 0.2 to 1.5 mm and most preferably from 0.25 to 1.0 mm, or iii) a ratio of particle length to particle thickness of from 2 to 60, more preferably from 5 to 60 and most preferably from 10 to 60.

Alternatively, the wood particle base layer comprises wood particles having i) a particle length in the range from 0.4 to 15 mm, more preferably from 3 to 15 mm and most preferably from 5 to 15 mm, and ii) a particle thickness in the range from 0.1 to 2.0 mm, more preferably from 0.2 to 1.5 mm and most preferably from 0.25 to 1.0 mm, and iii) a ratio of particle length to particle thickness of from 2 to 60, more preferably from 5 to 60 and most preferably from 10 to 60.

In one embodiment, the wood particle base layer comprises wood particles having a median particle size $d_{50}$ in the range from 0.4 to 15 mm, more preferably from 3 to 15 mm and most preferably from 5 to 15 mm.

Additionally or alternatively, the wood particle base layer comprises wood particles having a median particle size $d_{90}$ in the range from 2 to 60, more preferably from 5 to 60 and most preferably from 10 to 60.

Specific examples of wood particles suitable for the wood particle base layer include cottonwood, spruce, pine, alder, birch, beech, oak and mixtures thereof.

It is one requirement of the wood particle base layer of the present particle board that it comprises the wood particles in an amount from 60.0 to 97.5 parts by weight (d/d), based on the total dry weight of the wood particles and at least one particulate calcium carbonate-containing material of the wood particle base layer. Preferably, the wood particle base layer comprises the wood particles in an amount from 70.0 to 95.0 parts by weight (d/d), based on the total dry weight of the wood particles and the at least one particulate calcium carbonate-containing material of the wood particle base layer. More preferably, the wood particle base layer comprises the wood particles in an amount from 70.0 to 90.0 parts by weight (d/d), based on the total dry weight of the wood particles and the at least one particulate calcium carbonate-containing material of the wood particle base layer.

Another essential component of the wood particle base layer of the present particle board is at least one particulate calcium carbonate-containing material. The at least one particulate calcium carbonate-containing material functions as wood particle replacement and thus decreases the amount of raw materials based on organic renewable resources in the wood particle base layer of the particle board.

The term "at least one" particulate calcium carbonate-containing material in the meaning of the present invention means that the particulate calcium carbonate-containing material comprises, preferably consists of, one or more particulate calcium carbonate-containing materials.

In one embodiment of the present invention, the at least one particulate calcium carbonate-containing material comprises, preferably consists of, one particulate calcium carbonate-containing material. Alternatively, the at least one particulate calcium carbonate-containing material comprises, preferably consists of, two or more particulate calcium carbonate-containing materials. For example, the at least one particulate calcium carbonate-containing material comprises, preferably consists of, two or three particulate calcium carbonate-containing materials.

Preferably, the at least one particulate calcium carbonate-containing material comprises, more preferably consists of, one particulate calcium carbonate-containing material.

The term at least one "particulate calcium carbonate-containing material" in the meaning of the present invention refers to a solid compound that comprises calcium carbonate.

According to one embodiment of the present invention, the at least one particulate calcium carbonate-containing material is selected from dolomite, at least one ground calcium carbonate (GCC), at least one precipitated calcium carbonate (PCC) and mixtures thereof.

"Dolomite" in the meaning of the present invention is a carbonatic calcium-magnesium-mineral having the chemical composition of $CaMg(CO_3)_2$ ("$CaCO_3.MgCO_3$"). Dolomite mineral contains at least 30.0 wt.-% $MgCO_3$, based on the total weight of dolomite, preferably more than 35.0 wt.-%, more than 40.0 wt.-%, typically from 45.0 to 46.0 wt.-% $MgCO_3$.

"Ground calcium carbonate" (GCC) in the meaning of the present invention is a calcium carbonate obtained from natural sources, such as limestone, marble or chalk, and processed through a wet and/or dry treatment such as grinding, screening and/or fractionating, for example by a cyclone or classifier.

According to one embodiment of the present invention the GCC is obtained by dry grinding. According to another embodiment of the present invention the GCC is obtained by wet grinding and subsequent drying.

In general, the grinding step can be carried out with any conventional grinding device, for example, under conditions such that refinement predominantly results from impacts with a secondary body, i.e. in one or more of: a ball mill, a rod mill, a vibrating mill, a roll crusher, a centrifugal impact mill, a vertical bead mill, an attrition mill, a pin mill, a hammer mill, a pulveriser, a shredder, a de-clumper, a knife cutter, or other such equipment known to the skilled man. In case calcium carbonate-containing material comprises a wet ground calcium carbonate-containing material, the grinding step may be performed under conditions such that autogenous grinding takes place and/or by horizontal ball milling, and/or other such processes known to the skilled man. The wet processed ground calcium carbonate-containing material thus obtained may be washed and dewatered by well-known processes, e.g. by flocculation, filtration or forced evaporation prior to drying. The subsequent step of drying may be carried out in a single step such as spray drying, or in at least two steps. It is also common that such a calcium carbonate material undergoes a beneficiation step (such as a flotation, bleaching or magnetic separation step) to remove impurities.

In one embodiment of the present invention, the GCC is selected from the group comprising marble, chalk, limestone and mixtures thereof.

"Precipitated calcium carbonate" (PCC) in the meaning of the present invention is a synthesized material, generally obtained by precipitation following reaction of carbon dioxide and lime in an aqueous environment or by precipitation of a calcium and carbonate ion source in water. PCC may be one or more of the aragonitic, vateritic and calcitic mineralogical crystal forms. Preferably, PCC is one of the aragonitic, vateritic and calcitic mineralogical crystal forms.

Aragonite is commonly in the acicular form, whereas vaterite belongs to the hexagonal crystal system. Calcite can form scalenohedral, prismatic, spheral and rhombohedral forms. PCC can be produced in different ways, e.g. by precipitation with carbon dioxide, the lime soda process, or the Solvay process in which PCC is a by-product of ammonia production. The obtained PCC slurry can be mechanically dewatered and dried.

It is preferred that the at least one particulate calcium carbonate-containing material comprises at least one ground calcium carbonate (GCC), preferably at least one ground calcium carbonate (GCC) being selected from the group comprising marble, chalk, limestone and mixtures thereof. In one preferred embodiment, the at least one ground calcium carbonate (GCC) is marble or chalk.

In addition to calcium carbonate, the at least one particulate calcium carbonate-containing material may comprise further metal oxides such as titanium dioxide and/or aluminium trioxide, metal hydroxides such as aluminium trihydroxide, metal salts such as sulphates, silicates such as talc and/or kaolin clay and/or mica, carbonates such as magnesium carbonate and/or gypsum, satin white and mixtures thereof.

According to one embodiment of the present invention, the amount of calcium carbonate in the at least one particulate calcium carbonate-containing material is of 10.0 wt.-%, preferably of 20.0 wt.-%, based on the total dry weight of the calcium carbonate-containing material.

It is appreciated that the amount of calcium carbonate in the at least one particulate calcium carbonate-containing material is preferably of 50.0 wt.-%, even more preferably of 90.0 wt.-%, more preferably of ≥95.0 wt.-% and most preferably of ≥97.0 wt.-%, based on the total dry weight of the calcium carbonate-containing material.

It is advantageous that the at least one particulate calcium carbonate-containing material has specific dimensions in order to function as wood particle replacement in the wood particle base layer. For example, the at least one particulate calcium carbonate-containing material of the wood particle base layer has a weight median particle size $d_{50}$ from 1.0 μm to 1 000.0 μm, more preferably from 15.0 μm to 1 000.0 μm and most preferably from 30.0 μm to 1 000.0 μm.

Additionally or alternatively, the at least one particulate calcium carbonate-containing material of the wood particle base layer has a specific surface area of ≤5.0 $m^2/g$, more preferably from 0.1 to 5.0 $m^2/g$ and most preferably of from 0.2 to 1.0 $m^2/g$ as measured by the BET nitrogen method. The term "specific surface area" (in $m^2/g$) of the at least one particulate calcium carbonate-containing material in the meaning of the present invention is determined using the BET method, which is well known to the skilled man (ISO 9277:1995).

Additionally or alternatively, the at least one particulate calcium carbonate-containing material of the wood particle base layer has a top cut $d_{98}$ from 100.0 to 1 200.0 μm, more preferably from 250.0 μm to 1 100.0 μm and most preferably from 500.0 μm to 1 000.0 μm. The term "top cut" (or top size), as used herein, means the particle size value wherein at least 98.0 wt.-% of the material particles are less than that size.

In one embodiment, the at least one particulate calcium carbonate-containing material of the wood particle base layer has a weight median particle size $d_{50}$ from 1.0 μm to 1 000.0 μm, more preferably from 15.0 μm to 1 000.0 μm and most preferably from 30.0 μm to 1 000.0 μm, or a specific surface area of ≤5.0 $m^2/g$, more preferably from 0.1 to 5.0 $m^2/g$ and most preferably of from 0.2 to 1.0 $m^2/g$ as measured by the BET nitrogen method, or a top cut $d_{98}$ from 100.0 to 1 200.0 μm, more preferably from 250.0 μm to 1 100.0 μm and most preferably from 500.0 μm to 1 000.0 μm.

Alternatively, the at least one particulate calcium carbonate-containing material of the wood particle base layer has a weight median particle size $d_{50}$ from 1.0 μm to 1 000.0 μm, more preferably from 15.0 μm to 1 000.0 μm and most preferably from 30.0 μm to 1 000.0 μm, and a specific surface area of ≤5.0 $m^2/g$, more preferably from 0.1 to 5.0 $m^2/g$ and most preferably of from 0.2 to 1.0 $m^2/g$ as measured by the BET nitrogen method, and a top cut $d_{98}$ from 100.0 to 1 200.0 μm, more preferably from 250.0 μm to 1 100.0 μm and most preferably from 500.0 μm to 1 000.0 μm.

It is appreciated that the wood particle base layer comprises the at least one particulate calcium carbonate-containing material in an amount from 2.5 to 40.0 parts by weight (d/d), based on the total dry weight of the wood particles and at least one particulate calcium carbonate-containing material of the wood particle base layer.

The term "dry" with regard to the at least one particulate calcium carbonate-containing material is understood to be a material having less than 0.3% by weight of water relative to the weight of the at least one particulate calcium carbonate-containing material. The % water content is determined according to the Coulometric Karl Fischer measurement method, wherein the at least one particulate calcium carbonate-containing material is heated to 220° C., and the water content released as vapour and isolated using a stream of nitrogen gas (at 100 ml/min) is determined in a Coulometric Karl Fischer unit.

The term "dry" with regard to the wood particles is understood to be absolutely dry wood particles having 0% by weight of water relative to the weight of the wood particles. The "absolutely dry wood particles" are determined by treating the wood particles at 103±2° C. to constant weight in accordance with DIN EN 322.

Preferably, the wood particle base layer of the present particle board comprises the at least one particulate calcium carbonate-containing material in an amount from 5.0 to 30.0 parts by weight (d/d), based on the total dry weight of the wood particles and at least one particulate calcium carbonate-containing material of the wood particle base layer. More preferably, the wood particle base layer comprises the at least one particulate calcium carbonate-containing material in an amount from 10.0 to 30.0 parts by weight (d/d), based on the total dry weight of the wood particles and at least one particulate calcium carbonate-containing material of the wood particle base layer.

It is one requirement of the wood particle base layer that the sum of the amount of the wood particles and the at least one particulate calcium carbonate-containing material in the wood particle base layer is 100.0 parts by weight (d/d), based on the total dry weight of the wood particles and the at least one particulate calcium carbonate-containing material in the layer.

Thus, the wood particle base layer comprises, preferably consists of, the wood particles in an amount from 60.0 to 97.5 parts by weight (d/d) and the at least one particulate calcium carbonate-containing material in an amount from 2.5 to 40.0 parts by weight (d/d), based on the total dry weight of the wood particles and at least one particulate calcium carbonate-containing material of the wood particle base layer. Preferably, the wood particle base layer comprises, preferably consists of, the wood particles in an amount from 70.0 to 95.0 parts by weight (d/d) and the at least one particulate calcium carbonate-containing material in an amount from 5.0 to 30.0 parts by weight (d/d), based on the total dry weight of the wood particles and the at least one particulate calcium carbonate-containing material of the wood particle base layer. More preferably, the wood particle base layer comprises, preferably consists of, the wood particles in an amount from 70.0 to 90.0 parts by weight (d/d) and the at least one particulate calcium carbonate-containing material in an amount from 10.0 to 30.0 parts by weight (d/d), based on the total dry weight of the wood particles and the at least one particulate calcium carbonate-containing material of the wood particle base layer.

It is thus appreciated that the wood particle base layer of the particle board comprises a material consisting of the wood particles and the at least one particulate calcium carbonate-containing material, i.e. a part of the wood particles is replaced with the at least one particulate calcium carbonate-containing material.

The wood particle base layer may comprise one or more additives well known to the skilled person and typically used in the wood particle base layer of particle boards.

For example, the wood particle base layer comprises at least one binder in an amount from 0.05 to 25.0 parts by weight (d/d), based on the total dry weight of the wood particles and the at least one particulate calcium carbonate-containing material.

The at least one binder may be a natural or synthetic binder well known to the skilled person. For example, the at least one binder may be selected from the group comprising phenol-formaldehyde resin (PF), urea-formaldehyde resin (UF), melamine-formaldehyde resin (MF), melamine-urea-formaldehyde resin (MUF), urea-melamine-formaldehyde resin (UMF), urea-melamine-phenol-formaldehyde resin (UMPF), epoxy resin, methylene diphenyl diisocyanate resin (MDI), polyurethane resin (PU), resorcin resin, starch or carboxymethylcellulose and mixtures thereof. Preferably, the at least one binder is selected from the group comprising phenol-formaldehyde resin (PF), urea-formaldehyde resin (UF), melamine-formaldehyde resin (MF), melamine-urea-formaldehyde resin (MUF), urea-melamine-formaldehyde resin (UMF), urea-melamine-phenol-formaldehyde resin (UMPF), epoxy resin, methylene diphenyl diisocyanate resin (MDI), polyurethane resin (PU) and mixtures thereof. Most preferably, the at least one binder is urea-formaldehyde resin (UF).

In one embodiment, the wood particle base layer further comprises at least one compound selected from the group comprising waxes, colorants, filler (differing from the at least one particulate calcium carbonate-containing material), dispersants, biocides, hardener and flame retardants. Such compounds are well known to the skilled person and typically used in the wood particle base layer of particle boards.

The amount of each of these compounds to be optionally included can be determined in accordance with standard practice and with the desired properties of the final fibre board product in mind. Advantageously, the wood particle base layer will preferably include less than 10.0 parts by weight (d/d), more preferably less than 5.0 parts by weight (d/d) and most preferably less than 2.0 parts by weight (d/d), such as from 0.1 to 1.5 parts by weight (d/d), based on the total dry weight of the wood particles and the at least one particulate calcium carbonate-containing material in the layer, of said at least one compound.

Thus, the wood particle base layer comprises, preferably consists of, wood particles in an amount from 60.0 to 97.5 parts by weight (d/d) and at least one particulate calcium carbonate-containing material in an amount from 2.5 to 40.0 parts by weight (d/d), wherein the sum of the amount of the wood particles and the at least one particulate calcium carbonate-containing material in the wood particle base layer is 100.0 parts by weight (d/d), and at least one binder in an amount from 0.05 to 25.0 parts by weight (d/d). The parts by weight are based on the total dry weight of the wood particles and the at least one particulate calcium carbonate-containing material in the layer.

In one embodiment, the wood particle base layer comprises, preferably consists of, wood particles in an amount from 60.0 to 97.5 parts by weight (d/d) and at least one particulate calcium carbonate-containing material in an amount from 2.5 to 40.0 parts by weight (d/d), wherein the sum of the amount of the wood particles and the at least one particulate calcium carbonate-containing material in the wood particle base layer is 100.0 parts by weight (d/d), and at least one binder in an amount from 0.05 to 25.0 parts by weight (d/d), and at least one compound selected from the group comprising waxes, colorants, filler (differing from the at least one particulate calcium carbonate-containing material), dispersants, biocides, hardener and flame retardants, preferably in an amount of less than 10.0 parts by weight (d/d). The parts by weight are based on the total dry weight of the wood particles and the at least one particulate calcium carbonate-containing material in the layer.

Wood Particle Surface Layer

According to point b) of the present invention, the particle board comprises at least one wood particle surface layer being in contact with the first and/or reverse side of the wood particle base layer and the at least one wood particle surface layer comprises wood particles in an amount from 70.0 to 97.5 parts by weight (d/d) and at least one particulate calcium carbonate-containing material in an amount from 2.5 to 30.0 parts by weight (d/d), based on the total dry weight of the wood particles and the at least one particulate calcium carbonate-containing material of the at least one wood particle surface layer.

It is appreciated that the particle board comprises at least one wood particle surface layer.

The term "at least one" wood particle surface layer in the meaning of the present invention means that the particle board comprises one or more wood particle surface layer(s).

In one embodiment of the present invention, the particle board comprises one wood particle surface layer. Alternatively, the particle board comprises two or more wood particle surface layers. For example, the particle board comprises two or three or four wood particle surface layers.

Preferably, the particle board comprises two or four, e.g. two, wood particle surface layers.

It is appreciated that the at least one wood particle surface layer of the particle board preferably comprises one or more kinds of wood particles.

Accordingly, the at least one wood particle surface layer may comprise one kind of wood particles. Alternatively, the at least one wood particle surface layer comprises a mixture of two or more kinds of wood particles. For example, the at least one wood particle surface layer comprises a mixture of two or three kinds of wood particles. Preferably, the at least one wood particle surface layer comprises one kind of wood particles.

It is appreciated that the wood particles present in the at least one wood particle surface layer according to the present invention are not restricted to specific wood particles as long as they are suitable for the preparation of a wood particle surface layer of a particle board.

With regard to the definition of the wood particles present in the at least one wood particle surface layer and preferred embodiments thereof, unless indicated otherwise, reference is made to the statements provided above when discussing the technical details of the wood particle base layer.

In one embodiment, the wood particles of the wood particle base layer and of the at least one wood particle surface layer are the same or different. For example, the wood particles of the wood particle base layer and of the at least one wood particle surface layer are the same.

Preferably, the wood particles of the wood particle base layer and of the at least one wood particle surface layer are different. For example, the wood particles of the wood particle base layer and of the at least one wood particle surface layer differ in their dimensions.

In one embodiment, the at least one wood particle surface layer comprises wood particles having i) a particle length in the range from 0.4 to 15 mm, more preferably from 3 to 15 mm and most preferably from 3 to 10 mm, and/or
ii) a particle thickness in the range from 0.1 to 2.0 mm, more preferably from 0.1 to 1.0 mm and most preferably from 0.1 to 0.5 mm, and/or
iii) a ratio of particle length to particle thickness of from 2 to 60, more preferably from 10 to 50 and most preferably from 15 to 50.

Preferably, the at least one wood particle surface layer comprises wood particles having i) a particle length in the range from 0.4 to 15 mm, more preferably from 3 to 15 mm and most preferably from 3 to 10 mm, or
ii) a particle thickness in the range from 0.1 to 2.0 mm, more preferably from 0.1 to 1.0 mm and most preferably from 0.1 to 0.5 mm, or
iii) a ratio of particle length to particle thickness of from 2 to 60, more preferably from 10 to 50 and most preferably from 15 to 50.

Alternatively, the at least one wood particle surface layer comprises wood particles having i) a particle length in the range from 0.4 to 15 mm, more preferably from 3 to 15 mm and most preferably from 3 to 10 mm, and
ii) a particle thickness in the range from 0.1 to 2.0 mm, more preferably from 0.1 to 1.0 mm and most preferably from 0.1 to 0.5 mm, and
iii) a ratio of particle length to particle thickness of from 2 to 60, more preferably from 10 to 50 and most preferably from 15 to 50.

In one embodiment, the at least one wood particle surface layer comprises wood particles having a median particle size $d_{50}$ in the range from 0.4 to 15 mm, more preferably from 3 to 15 mm and most preferably from 3 to 10 mm.

Additionally or alternatively, the at least one wood particle surface layer comprises wood particles having a median particle size $d_{90}$ in the range from 2 to 60, more preferably from 10 to 50 and most preferably from 15 to 50.

It is preferred that the particle length and/or particle thickness of the wood particles in the at least one wood particle surface layer is below the particle length and/or particle thickness of the wood particles in the wood particle base layer.

For example, the ratio of the particle length of the wood particles in the at least one wood particle base layer to the particle length of the wood particles in the wood particle surface layer [length base layer/length surface layer] is preferably >1.0, more preferably ≥1.1, even more preferably ≥1.2, still more preferably ≥1.3 and most preferably ≥1.5, e.g. from 1.5 to 3.0.

Additionally or alternatively, the ratio of the particle thickness of the wood particles in the at least one wood particle base layer to the particle thickness of the wood particles in the wood particle surface layer [thickness base layer/thickness surface layer] is preferably >1.0, more preferably ≥1.1, even more preferably ≥1.2, still more preferably ≥1.3 and most preferably ≥1.5, e.g. from 1.5 to 3.0.

It is one requirement of the at least one wood particle surface layer of the present particle board that it comprises the wood particles in an amount from 70.0 to 97.5 parts by weight (d/d), based on the total dry weight of the wood particles and the at least one particulate calcium carbonate-containing material of the at least one wood particle surface layer. Preferably, the at least one wood particle surface layer of the present particle board comprises the wood particles in an amount from 75.0 to 95.0 parts by weight (d/d), based on the total dry weight of the wood particles and the at least one particulate calcium carbonate-containing material of the at least one wood particle surface layer. More preferably, the at least one wood particle surface layer of the present particle board comprises the wood particles in an amount from 78.0 to 92.0 parts by weight (d/d), based on the total dry weight of the wood particles and the at least one particulate calcium carbonate-containing material of the at least one wood particle surface layer.

Another essential component of the at least one wood particle surface layer of the present particle board is at least one particulate calcium carbonate-containing material. The at least one particulate calcium carbonate-containing material functions as wood particle replacement and thus decreases the amount of raw materials based on organic renewable resources in the at least one wood particle surface layer of the particle board.

With regard to the definition of the at least one particulate calcium carbonate-containing material present in the at least one wood particle surface layer and preferred embodiments thereof, unless indicated otherwise, reference is made to the statements provided above when discussing the technical details of the wood particle base layer.

In one embodiment, the at least one particulate calcium carbonate-containing material comprises, more preferably consists of, one particulate calcium carbonate-containing material.

According to one embodiment of the present invention, the at least one particulate calcium carbonate-containing material is selected from dolomite, at least one ground calcium carbonate (GCC), at least one precipitated calcium carbonate (PCC) and mixtures thereof. For example, the GCC is selected from the group comprising marble, chalk, limestone and mixtures thereof. In one preferred embodiment, the at least one ground calcium carbonate (GCC) is marble or chalk.

The PCC is preferably one of the aragonitic, vateritic and calcitic mineralogical crystal forms.

In one embodiment, the at least one particulate calcium carbonate-containing material of the wood particle base layer and of the at least one wood particle surface layer are the same or different. For example, the at least one particulate calcium carbonate-containing material of the wood particle base layer and of the at least one wood particle surface layer are the same.

Preferably, the at least one particulate calcium carbonate-containing material of the wood particle base layer and of the at least one wood particle surface layer are different. For example, the at least one particulate calcium carbonate-containing material of the wood particle base layer and of the at least one wood particle surface layer differ in their weight median particle size $d_{50}$.

Thus, the at least one particulate calcium carbonate-containing material preferably has specific dimensions in order to function as wood particle replacement in the at least one wood particle surface layer. For example, the at least one particulate calcium carbonate-containing material of the at least one wood particle surface layer has a weight median particle size $d_{50}$ from 1.0 μm to 1 000.0 μm, more preferably from 15.0 μm to 1 000.0 μm and most preferably from 30.0 μm to 1 000.0 μm.

It is preferred that the particle size $d_{50}$ of the at least one particulate calcium carbonate-containing material in the at least one wood particle surface layer is preferably below the particle size $d_{50}$ of the at least one particulate calcium carbonate-containing material in the wood particle base layer.

Additionally or alternatively, the at least one particulate calcium carbonate-containing material of the at least one wood particle surface layer has a specific surface area of ≤5.0 $m^2/g$, more preferably from 0.1 to 5.0 $m^2/g$ and most preferably of from 0.2 to 1.0 $m^2/g$ as measured by the BET nitrogen method.

Additionally or alternatively, the at least one particulate calcium carbonate-containing material of the at least one wood particle surface layer has a top cut $d_{98}$ from 100.0 to 1 200.0 μm, more preferably from 250.0 μm to 1 100.0 μm and most preferably from 500.0 μm to 1 000.0 μm.

In one embodiment, the at least one particulate calcium carbonate-containing material of the at least one wood particle surface layer has a weight median particle size $d_{50}$ from 1.0 μm to 1 000.0 μm, more preferably from 15.0 μm to 1 000.0 μm and most preferably from 30.0 μm to 1 000.0 μm, or a specific surface area of ≤5.0 $m^2/g$, more preferably from 0.1 to 5.0 $m^2/g$ and most preferably of from 0.2 to 1.0 $m^2/g$ as measured by the BET nitrogen method, or a top cut $d_{98}$ from 100.0 to 1 200.0 μm, more preferably from 250.0 μm to 1 100.0 μm and most preferably from 500.0 μm to 1 000.0 μm.

Alternatively, the at least one particulate calcium carbonate-containing material of the at least one wood particle surface layer has a weight median particle size $d_{50}$ from 1.0 μm to 1 000.0 μm, more preferably from 15.0 μm to 1 000.0 μm and most preferably from 30.0 μm to 1 000.0 μm, and a specific surface area of ≤5.0 $m^2/g$, more preferably from 0.1 to 5.0 $m^2/g$ and most preferably of from 0.2 to 1.0 $m^2/g$ as measured by the BET nitrogen method, and a top cut $d_{98}$ from 100.0 to 1 200.0 μm, more preferably from 250.0 μm to 1 100.0 μm and most preferably from 500.0 μm to 1 000.0 μm.

It is appreciated that the at least one wood particle surface layer comprises the at least one particulate calcium carbonate-containing material in an amount from 2.5 to 30.0 parts by weight (d/d), based on the total dry weight of the wood particles and at least one particulate calcium carbonate-containing material of the at least one wood particle surface layer.

Preferably, the at least one wood particle surface layer of the present particle board comprises the at least one particulate calcium carbonate-containing material in an amount from 5.0 to 25.0 parts by weight (d/d), based on the total dry weight of the wood particles and at least one particulate calcium carbonate-containing material of the at least one wood particle surface layer. More preferably, the at least one wood particle surface layer comprises the at least one particulate calcium carbonate-containing material in an amount from 8.0 to 22.0 parts by weight (d/d), based on the total dry weight of the wood particles and at least one particulate calcium carbonate-containing material of the at least one wood particle surface layer.

It is one requirement of the at least one wood particle surface layer that the sum of the amount of the wood particles and the at least one particulate calcium carbonate-containing material in the at least one wood particle surface layer is 100.0 parts by weight (d/d), based on the total dry weight of the wood particles and the at least one particulate calcium carbonate-containing material in the layer.

Thus, the at least one wood particle surface layer comprises, preferably consists of, the wood particles in an amount from 70.0 to 97.5 parts by weight (d/d) and the at least one particulate calcium carbonate-containing material in an amount from 2.5 to 30.0 parts by weight (d/d), based on the total dry weight of the wood particles and at least one particulate calcium carbonate-containing material of the at least one wood particle surface layer. Preferably, the at least one wood particle surface layer comprises, preferably consists of, the wood particles in an amount from 75.0 to 95.0 parts by weight (d/d) and the at least one particulate calcium carbonate-containing material in an amount from 5.0 to 25.0 parts by weight (d/d), based on the total dry weight of the wood particles and the at least one particulate calcium carbonate-containing material of the at least one wood particle surface layer. More preferably, the at least one wood particle surface layer comprises, preferably consists of, the wood particles in an amount from 78.0 to 92.0 parts by weight (d/d) and the at least one particulate calcium carbonate-containing material in an amount from 8.0 to 22.0 parts by weight (d/d), based on the total dry weight of the wood particles and the at least one particulate calcium carbonate-containing material of the at least one wood particle surface layer.

It is thus appreciated that the at least one wood particle surface layer of the particle board comprises a material consisting of the wood particles and the at least one particulate calcium carbonate-containing material, i.e. a part of the wood particles is replaced with the at least one particulate calcium carbonate-containing material.

The at least one wood particle surface layer may comprise one or more additives well known to the skilled person and typically used in the at least one wood particle surface layer of particle boards.

For example, the at least one wood particle surface layer comprises at least one binder in an amount from 0.05 to 25.0 parts by weight (d/d), based on the total dry weight of the wood particles and the at least one particulate calcium carbonate-containing material.

The at least one binder may be a natural or synthetic binder well known to the skilled person. For example, the at least one binder may be selected from the group comprising phenol-formaldehyde resin (PF), urea-formaldehyde resin (UF), melamine-formaldehyde resin (MF), melamine-urea-formaldehyde resin (MUF), urea-melamine-formaldehyde resin (UMF), urea-melamine-phenol-formaldehyde resin (UMPF), epoxy resin, methylene diphenyl diisocyanate resin (MDI), polyurethane resin (PU), resorcin resin, starch or carboxymethylcellulose and mixtures thereof. Preferably, the at least one binder is selected from the group comprising phenol-formaldehyde resin (PF), urea-formaldehyde resin (UF), melamine-formaldehyde resin (MF), melamine-urea-formaldehyde resin (MUF), urea-melamine-formaldehyde resin (UMF), urea-melamine-phenol-formaldehyde resin (UMPF), epoxy resin, methylene diphenyl diisocyanate resin (MDI), polyurethane resin (PU) and mixtures thereof. Most preferably, the at least one binder is urea-formaldehyde resin (UF).

In one embodiment, the at least one wood particle surface layer further comprises at least one compound selected from the group comprising waxes, colorants, filler (differing from the at least one particulate calcium carbonate-containing material), dispersants, biocides, hardener and flame retardants. Such compounds are well known to the skilled person and typically used in the at least one wood particle surface layer of particle boards.

The amount of each of these compounds to be optionally included can be determined in accordance with standard practice and with the desired properties of the final fibre board product in mind. Advantageously, the at least one wood particle surface layer will preferably include less than 10.0 parts by weight (d/d), more preferably less than 5.0 parts by weight (d/d) and most preferably less than 2.0 parts by weight (d/d), such as from 0.1 to 1.5 parts by weight (d/d), based on the total dry weight of the wood particles and the at least one particulate calcium carbonate-containing material in the layer, of said at least one compound.

Thus, the at least one wood particle surface layer comprises, preferably consists of, wood particles in an amount from 70.0 to 97.5 parts by weight (d/d) and at least one particulate calcium carbonate-containing material in an amount from 2.5 to 30.0 parts by weight (d/d), wherein the sum of the amount of the wood particles and the at least one particulate calcium carbonate-containing material in the at least one wood particle surface layer is 100.0 parts by weight (d/d), and at least one binder in an amount from 0.05 to 25.0 parts by weight (d/d). The parts by weight are based on the total dry weight of the wood particles and the at least one particulate calcium carbonate-containing material in the layer.

In one embodiment, the at least one wood particle surface layer comprises, preferably consists of, wood particles in an amount from 75.0 to 95.0 parts by weight (d/d) and at least one particulate calcium carbonate-containing material in an amount from 5.0 to 25.0 parts by weight (d/d), wherein the sum of the amount of the wood particles and the at least one particulate calcium carbonate-containing material in the at least one wood particle surface layer is 100.0 parts by weight (d/d), and at least one binder in an amount from 0.05 to 25.0 parts by weight (d/d), and at least one compound selected from the group comprising waxes, colorants, filler (differing from the at least one particulate calcium carbonate-containing material), dispersants, biocides, hardener and flame retardants, preferably in an amount of less than 10.0 parts by weight (d/d). The parts by weight are based on the total dry weight of the wood particles and the at least one particulate calcium carbonate-containing material in the layer.

According to another aspect of the present invention, a process for manufacturing a particle board as defined above is provided. The process comprising the steps of:

a) providing wood particles, as defined herein, in dry form,
b) providing at least one particulate calcium carbonate-containing material as defined herein,
c) optionally providing at least one binder as defined herein, and/or at least one compound as defined herein,
d) combining the wood particles of step a) simultaneously or separately in any order with the at least one particulate calcium carbonate-containing material of step b) and the optional at least one binder and/or at least one compound of step c) to form a wood particle-calcium carbonate-containing material mixture which is suitable to form a wood particle base layer mat,
e) combining the wood particles of step a) simultaneously or separately in any order with the at least one particulate calcium carbonate-containing material of step b) and the optional at least one binder and/or at least one compound of step c) to form a wood particle-calcium carbonate-containing material mixture which is suitable to form at least one wood particle surface layer mat,
f) forming a multi-layer mat of the wood particle-calcium carbonate-containing material mixtures obtained in steps d) and e), and
g) pressing the multi-layer mat of step f) in one or more steps into a solid particle board.

With regard to the definition of the wood particles, at least one particulate calcium carbonate-containing material, at least one binder and/or at least one compound and preferred embodiments thereof, reference is made to the statements provided above when discussing the technical details of the particle board of the present invention.

The manufacturing of particle boards may be undertaken by all the techniques and process lines well known to the man skilled in the art for manufacturing particle boards such as a continuous or discontinuous process. The particle boards are preferably manufactured in a continuous process.

Additionally or alternatively, the manufacturing of particle boards may be undertaken in a dry process which is well known to the man skilled in the art. Thus, the present particle boards are preferably manufactured in a dry process.

The wood particles to be provided in step a) of the process preferably have a moisture content of about 10.0 wt.-% or less, e.g. from 4 to 8 wt.-%, based on the total weight of the wood particles. It is appreciated that higher moisture contents are not preferred as it may be critical during pressing step g) and especially during hot pressing.

Thus, the wood particles may optionally by pre-dried to reduce their moisture content in case the moisture content is >10.0 wt.-%, based on the total weight of the wood particles. The optional pre-drying of the wood particles to the desired level is preferably carried out in a pre-dryer such as a tube dryer. Tube dryer such as single-stage or multiple-stage tube dryer are well known in the art and are widely used for drying wood particles in the manufacturing of particle boards. The wood particles can be dried for a time period and/or at a temperature sufficient to reduce the moisture content of the wood particles to the desired level. The drying time and/or temperature may be adjusted according to the temperature and the moisture content of the fibres.

Thus, it is appreciated that the wood particles are provided in dry form in the present process for manufacturing a particle board. The particle board is preferably manufactured in a dry process.

In case the wood particles are pre-dried, the wood particles leave the pre-dryer and are preferably passed into a blender. In the blender, the wood particles are combined with the at least one particulate calcium carbonate-containing material and the optional at least one binder and/or at least one compound.

In one embodiment of the present invention, the at least one particulate calcium carbonate-containing material is provided in step b) in powder form or in form of an aqueous suspension.

For example, the at least one particulate calcium carbonate-containing material is provided in dry form, i.e. in powder form.

If the at least one particulate calcium carbonate-containing material is provided in form of an aqueous suspension, the aqueous suspension preferably comprises the at least one particulate calcium carbonate-containing material in an amount from 1.0 to 80.0 wt.-%, based on the total weight of the aqueous suspension. More preferably, the aqueous suspension comprises the at least one particulate calcium carbonate-containing material in an amount from 30.0 to 78.0 wt.-%, more preferably from 50.0 to 78.0 wt.-% and most preferably from 70.0 to 78.0 wt.-%, based on the total weight of the aqueous suspension.

An aqueous "suspension" or "slurry" in the meaning of the present invention comprises insoluble solids and water and optionally further additives such as dispersants, biocides and/or thickener and usually may contain large amounts of solids and, thus, can be more viscous and generally of higher density than the liquid from which it is formed.

The term "aqueous" suspension or slurry refers to a system, wherein the liquid phase comprises, preferably consists of, water. However, said term does not exclude that the liquid phase of the aqueous slurry or suspension comprises minor amounts of at least one water-miscible organic solvent selected from the group comprising methanol, ethanol, acetone, acetonitrile, tetrahydrofuran and mixtures thereof. If the aqueous suspension or slurry comprises at least one water-miscible organic solvent, the liquid phase of the aqueous slurry comprises the at least one water-miscible organic solvent in an amount of from 0.1 to 40.0 wt.-% preferably from 0.1 to 30.0 wt.-%, more preferably from 0.1 to 20.0 wt.-% and most preferably from 0.1 to 10.0 wt.-%, based on the total weight of the liquid phase of the aqueous suspension or slurry. For example, the liquid phase of the aqueous suspension or slurry consists of water. If the liquid phase of the aqueous suspension or slurry consists of water, the water to be used can be any water available such as tap water and/or deionised water.

The aqueous suspension of the at least one particulate calcium carbonate-containing material may be formed by suspending the at least one particulate calcium carbonate-containing material provided in powder form in water.

In one embodiment of the present invention, said aqueous suspension has a pH of between 7 and 10, more preferably a pH from 7 to 9 and most preferably a pH from 8 to 9.

It is preferred that the particle board is manufactured in a dry process and thus the at least one particulate calcium carbonate-containing material is preferably provided in dry form.

For example, the wood particles and the at least one particulate calcium carbonate-containing material are provided in dry form.

It is appreciated that the optional at least one binder provided in optional process step c) is preferably at least one binder which curing reaction takes place under elevated temperature, e.g. ranging from 50 to 250° C., more preferably from 80 to 220° C., and/or in the presence of a hardener such as ammonium nitrate, ammonium chloride, ammonium sulphate or magnesium chloride. More preferably, the optional at least one binder provided in optional process step c) is at least one binder which curing reaction takes place under elevated temperature, e.g. ranging from 50 to 250° C., more preferably from 80 to 220° C., and in the presence of a hardener such as ammonium nitrate, ammonium chloride, ammonium sulphate or magnesium chloride.

According to step d), the wood particles are combined with the at least one particulate calcium carbonate-containing material and the optional at least one binder and/or at least one compound simultaneously or separately in any order to form a wood particle-calcium carbonate-containing material mixture which is suitable to form a wood particle base layer mat. Thus, for forming the wood particle base layer mat, the at least one particulate calcium carbonate-containing material and the optional at least one binder and/or at least one compound may be added simultaneously or separately in any order to the wood particles, in a manner known by the skilled person.

For example, process step d) is carried out in that the wood particles are combined simultaneously with the at least one particulate calcium carbonate-containing material and the optional at least one binder and/or at least one compound to form a wood particle-calcium carbonate-containing material mixture which is suitable to form the wood particle base layer mat. That is to say, said at least one particulate calcium carbonate-containing material and said optional at least one binder and/or at least one compound may be pre-mixed prior to addition to said wood particles.

Alternatively, process step d) is carried out in that the wood particles are combined separately with the at least one particulate calcium carbonate-containing material and the optional at least one binder and/or at least one compound to form a wood particle-calcium carbonate-containing material mixture which is suitable to form the wood particle base layer mat.

According to step e), the wood particles are combined with the at least one particulate calcium carbonate-containing material and the optional at least one binder and/or at least one compound simultaneously or separately in any order to form a wood particle-calcium carbonate-containing material mixture which is suitable to form at least one wood particle surface layer mat. Thus, for forming the at least one wood particle surface layer mat, the at least one particulate calcium carbonate-containing material and the optional at least one binder and at least one compound may be added simultaneously or separately in any order to the wood particles, in a manner known by the skilled person.

For example, process step e) is carried out in that the wood particles are combined simultaneously with the at least one particulate calcium carbonate-containing material and the optional at least one binder and/or at least one compound to form a wood particle-calcium carbonate-containing material mixture which is suitable to form the at least one wood particle surface layer mat. That is to say, said at least one particulate calcium carbonate-containing material and said optional at least one binder and/or at least one compound may be pre-mixed prior to addition to said wood particles. Alternatively, process step e) is carried out in that the wood particles are combined separately with the at least one particulate calcium carbonate-containing material and the optional at least one binder and/or at least one compound to form a wood particle-calcium carbonate-containing material mixture which is suitable to form the at least one wood particle surface layer mat.

In one embodiment, the addition of the at least one particulate calcium carbonate-containing material in dry form is carried out in process step d) and/or e) in that the at least one binder and/or at least one compound, if present, and the at least one particulate calcium carbonate-containing material are added independently from each other to the wood particles. For example, the at least one particulate calcium carbonate-containing material is added to the wood particles prior to the at least one binder and/or at least one compound, if present. Alternatively, the at least one particulate calcium carbonate-containing material is added to the wood particles after the at least one binder and/or at least one compound. It is to be noted that, if present, the at least one binder and at least one compound are preferably added simultaneously to the wood particles. For example, the at least one binder and the at least one compound, if present, are preferably added as a blend consisting of the at least one binder and the at least one compound. That is to say, said at least one binder and at least one compound, if present, may be pre-mixed prior to the addition to said wood particles.

Preferably, the wood particles are first combined with the optional at least one binder and/or at least one compound and then with the at least one particulate calcium carbonate-containing material.

Process steps d) and e) preferably take place in a blender.

As already indicated above, a wood particle-calcium carbonate-containing material mixture which is suitable to form a wood particle base layer mat and a wood particle-calcium carbonate-containing material mixture which is suitable to form at least one wood particle surface layer mat are formed in process steps d) and e).

It is appreciated that the term "wood particle-calcium carbonate-containing material mixture which is suitable to form a wood particle base layer mat" refers to a mixture of the wood particles, the at least one calcium carbonate-containing material and the optional at least one binder and/or at least one compound which is used for forming the final wood particle base layer. The term "wood particle-calcium carbonate-containing material mixture which is suitable to form at least one wood particle surface layer mat" refers to a mixture of the wood particles, the at least one calcium carbonate-containing material and the optional at least one binder and/or at least one compound which is used for forming the final at least one wood particle surface layer. Thus, the composition of the wood particle-calcium carbonate-containing material mixture which is suitable to form a wood particle base layer mat may differ, e.g. in the composition, from the wood particle-calcium carbonate-containing material mixture which is suitable to form at least one wood particle surface layer mat.

The wood particle-calcium carbonate-containing material mixture which is suitable to form a wood particle base layer mat and the wood particle-calcium carbonate-containing material mixture which is suitable to form at least one wood particle surface layer obtained in process steps d) and e) are than laid into an even and consistent multi-layer mat. This may be accomplished in batch mode or by continuous formation, preferably continuous formation.

According to step f) of the present process, a multi-layer mat of the wood particle-calcium carbonate-containing material mixtures obtained in steps d) and e) is thus formed.

The forming step f) may be undertaken by all the techniques and methods well known to the man skilled in the art for forming a multi-layer mat of wood particle-calcium carbonate-containing material mixtures. The forming step f) may be carried out with any conventional forming machine, for example, under conditions such that a continuous multi-layer mat of the wood particle-calcium carbonate-containing material mixtures obtained in steps d) and e) or the optional dryer is obtained or other such equipment known to the skilled person. For example, the wood particle-calcium carbonate-containing material mixture obtained in steps d) and e) or the optional dryer is spread by the back- and forth-movement of a tray or hopper feeder or air separation for forming the multi-layer mat.

In one embodiment, the multi-layer mat is formed in multiple forming steps. For example, a three-layer mat is formed in three or more forming steps.

It is appreciated that the multi-layer mat is preferably formed by distributing the wood particle-calcium carbonate-containing material mixture which is suitable to form a wood particle base layer mat and the wood particle-calcium carbonate-containing material mixture which is suitable to form at least one wood particle surface layer obtained in process steps d) and e) or the optional dryer in several layers, e.g. on traveling cauls or on a moving belt.

According to step g), the multi-layer mat obtained in step f) is then pressed in one or more steps into a solid particle board.

For example, process step g) comprises one or more hot pressing steps.

In one embodiment, the multi-layer mat obtained in step f) is prepressed prior to hot pressing. Thus, process step g) preferably comprises, more preferably consists of, a prepressing of the multi-layer mat of step f) followed by a hot pressing of the prepressed mat into a solid particle board.

If the multi-layer mat obtained in step f) is subjected to a prepressing, the prepressing may be carried out by all the techniques and methods well known to the man skilled in the art for prepressing multi-layer mats into a prepressed multi-layer mat. The prepressing may be carried out with any conventional pressing machine, e.g. single-opening presses, multi-opening batch presses or continuous presses, under conditions such that a prepressed mat is obtained or other such equipment known to the skilled person.

It is appreciated that the prepressing temperature, optional pressure, and time will vary according to the solid particle board to be produced. The prepressing is preferably carried out at a temperature ranging from 10 to <130° C., more preferably from 15 to <130° C. Additionally or alternatively, the prepressing is carried out at a pressure ranging from 10 to 15 bar.

The hot pressing of step g) may be undertaken by all the techniques and methods well known to the man skilled in the art for hot pressing a multi-layer mat into a solid particle board. The hot pressing of step g) may be carried out with any conventional pressing machine, e.g. single-opening presses, multi-opening batch presses or continuous presses, under conditions such that a solid particle board is obtained or other such equipment known to the skilled person. Preferably, pressing step g) is carried out with a continuous press.

For example, heat and optionally pressure, preferably heat and pressure, are applied to the multi-layer mat in the hot pressing step such as to join together the wood particle base layer and the at least one wood particle surface layer as well as the wood particles, the at least one particulate calcium carbonate-containing material and the optional at least one binder and/or at least one compound contained therein into a solid particle board in pressing step g).

It is appreciated that the hot pressing temperature, optional pressure, and time will vary according to the solid particle board to be produced. However, the hot pressing in step g) is preferably carried out at a temperature ranging from 130 to 250° C., more preferably from 150 to 230° C.

In one embodiment, the hot pressing is carried out at a pressing time factor, in relation to board thickness, of 10 to 25 s/mm, preferably of 10 to 20 s/mm and most preferably of 12 to 18 s/mm.

After pressing step g), the final solid particle board can be cooled prior to stacking. The final particle board may then be optionally sanded and/or trimmed to the final desired dimensions, any other finishing operations (such as laminate or coating or direct printing application) may be further done.

In view of the very good results of the at least one particulate calcium carbonate-containing material as wood particle replacement in the particle board as defined above, a further aspect of the present invention refers to the use of at least one particulate calcium carbonate-containing material as wood particle replacement in a particle board. Preferably, the at least one particulate calcium carbonate-containing material has a weight median particle size $d_{50}$ from 1.0 μm to 1 000.0 μm, more preferably from 15.0 μm to 1 000.0 μm and most preferably from 30.0 μm to 1 000.0 μm.

With regard to the definition of the particle board and the at least one particulate calcium carbonate-containing material and preferred embodiments thereof, reference is made to the statements provided above when discussing the technical details of the particle board of the present invention.

The scope and interest of the invention will be better understood based on the following examples which are intended to illustrate certain embodiments of the invention and are non-limitative.

EXAMPLES

Measurement Methods

The following measurement methods are used to evaluate the parameters given in the examples and claims.

Particle Size Distribution (Mass % Particles with a Diameter <X) and Weight Median Diameter ($d_{50}$) of a Particulate Calcium Carbonate-Containing Material Weight median grain diameter and grain diameter mass distribution of a particulate calcium carbonate-containing material were determined via laser diffraction, i.e. the particle size is determined by measuring the intensity of light scattered as a laser beam passes through a dispersed particulate sample. The measurement was made with a Mastersizer 2000 or a Mastersizer 3000 of Malvern Instruments Ltd. (operating instrument software version 1.04). Alternatively, the measurement can be made with a HELOS particle-size-analyzer of Sympatec, Germany.

The method and the instruments are known to the skilled person and are commonly used to determine grain size of fillers and pigments. The measurement is carried out in an aqueous solution of 0.1 wt.-% $Na_4P_2O_7$. The samples are dispersed using a high speed stirrer and supersonics.

Particle Size of Wood Particles

Particle sizes of wood particles were determined by mechanical vibration sieves and calculation of grading curves. Sieves with differing sieve meshes were setup as a tower starting with the smallest sieve mesh on the bottom and the largest sieve mesh on the top. The wood particles were placed on the top sieve and the sieve tower was fixed in a vibrating machine. The wood particles are thus subjected to fractioning by continuous shaking of the sieve tower within a timer period of 5 min. The balance between the amount of wood particles before being placed on the top sieve and after fractioning was considered as the through fraction in gram. Thus, for each sieve mesh width the percentage of the total amount of wood particles which is fractionized can be calculated. The mesh widths of the sieves were chosen among the following mesh widths (in mm): 0.063-0.1-0.315-0.5-1.0-1.6-2.0-3.15-4.0-6.3-8-12.

For each analysis at least seven mesh widths were chosen such that the size of the wood particles was sufficiently covered by the chosen mesh widths.

The particle length and thickness of the wood particles were determined by electron microscopic analysis, such as transmission electron microscope (TEM) or scanning electron microscope (SEM).

Wood Moisture Content

The wood moisture content is determined in accordance with DIN EN 322. The term "equilibrium moisture" has to be understood as moisture content of wood or wood based panel at which the wood neither gains nor loses moisture when surrounded by air at a given relative humidity and temperature (definition in "wood hand book") The moisture content was determined after 7 days storage in a defined climate of: 65% relative humidity and 20° C. temperature.

BET Specific Surface Area of a Material

Throughout the present document, the specific surface area (in $m^2/g$) of the mineral filler is determined using the BET method (using nitrogen as adsorbing gas), which is well known to the skilled man (ISO 9277:1995). The total surface area (in $m^2$) of the mineral filler is then obtained by multiplication of the specific surface area and the mass (in g) of the mineral filler prior to treatment.

pH of an Aqueous Slurry

The pH of the aqueous slurry was measured using a standard pH-meter at room temperature, approximately 22° C.

Density

Density (or raw density) measurements were made in accordance with DIN EN 323.

Thickness Swelling

Thickness swelling measurements were made after 24 h water exposure in accordance with DIN EN 317.

Internal Bond Strength

Internal bond strength measurements were made in accordance with DIN EN 319.

Bending Strength and Modulus of Elasticity

Bending strength and modulus of elasticity were measured in accordance with DIN EN 310.

Solids Content

The solids content was measured using a Moisture Analyzer of Mettler-Toledo HP43. The method and the instrument are known to the skilled person.

d/d

The term "d/d" (dry/dry) refers to the dry amount based on the dry amount of the defined solid material.

Calcium Carbonate Content

For the measurement of the calcium carbonate content in a fibre board product, clean crucibles were placed in a preheated muffle furnace at 560° C. for approximately 1 hour. The crucibles were allowed to cool down in a desiccators for about 20 to 30 min and then weighed accurate to 0.0001 grams. Subsequently, the fibre board product was crushed down and accurately weighed into a crucible. The organic material was slowly burned off in that the crucible with the fibre board product was placed in the cooled muffle furnace (approximately 23-100° C.) and then the temperature was set to 560° C., while the opening on the top of the furnace was kept about three quarters closed to ensure a slow ashing. After approximately 1 hour, the opening on the top of the furnace was completely opened allowing more air in for faster ashing. The samples were left in the furnace until the ash in the crucibles turned white, indicating removal of all carbon from charring. After cooling in a desiccator, the crucible was weighed with the obtained residue. The values given herein are the average of two measurements of independently prepared samples.

10.000 grams of the obtained residue were weighed in a flask/beaker and a small amount of demineralized water was added. If the calcium carbonate content of a particulate calcium carbonate-containing material was to be determined, 10.000 grams of the dry sample (dried at 110° C. for 5 hours in an oven) were weighed in a flask/beaker and a small amount of demineralized water was added. Then, 40 mL of hydrochloric acid (25% p.a.) were added to the respective sample and after the $CO_2$ development stopped, the mixture was boiled for about 5 min. After cooling down, the mixture was filtered through a 0.8 μm cellulose-acetate filter and washed thoroughly. Then the filtrate was quantitatively rinsed to a volumetric flask with distilled water and filled up to 1 000.0 ml at 20° C.

The thus obtained filtrate was then slowly titrated by pipetting 10.00 mL of the obtained filtrate (about 20° C.) into a Memotitrator-beaker and 1.0 g (±0.2 g) of triethanolamine puris. and 3.0 g of $MgSO_4 \times 7\ H_2O$. The mixture was diluted with demineralized water up to 70 mL and then, just before the titration, 10.0 mL of 2N sodium hydroxide and 7 to 9 drops of a HHSNN-methanol solution (0.2 wt.-% of HHSNN (calconcarboxylic acid) in methanol) were added to the mixture. After the pre-dosing, the titrator stirred the mixture for 60 s and then the phototrode voltage was set to 900 to 1150 mV during titration. The calcium carbonate content was displayed in percent.

Materials $CaCO_3$ A: Omyacarb 1 AV, in the form of a powder (97.5 wt. % calcium carbonate content), is a marble form Avenza-Carrara (Italy) deposit and was obtained from Omya and has a weight median particle size $d_{50}$ value of 1.7 μm.

$CaCO_3$ B: Omyacarb 40 GU, in the form of a powder (98 wt. % calcium carbonate content), is a marble from Avenza-Carrara (Italy) deposit and was obtained from Omya. Omyacarb 40 GU has a weight median particle size $d_{50}$ value of 26 μm.

$CaCO_3$ C: Carolith 0.2-0.5 NP, in the form of a bulk material (98 wt. % calcium carbonate content), is a marble from Hausmening (Austria) deposit and was obtained from Omya. Carolith 0.2-0.5 NP has a weight median particle size $d_{50}$ value of 340 μm.

Test 1

The present test shows the influence of the replacement of wood particles with a calcium carbonate-containing material with different layouts with respect to the mean particle size and particle size distribution, on mechanical properties of a particle board.

a) Comparative Particle Board

The comparative particle-board (CE) is characterized in that the board only comprises wood particles, i.e. wood particles are not replaced by a calcium carbonate containing material.

The wood particles used were from industrial production and included a mixture of wood species (pine, spruce etc.) and had their origin in primary wood sources (round wood) or secondary wood sources (saw mill by products, wood chips, recycled wood etc.). The wood particles are classified in two groups: A) wood particles for the middle layer (ML) and B) wood particles for the surface layer (SL).

The middle layer (ML) particles had a particle size $d_{50}$ of about 9 mm and a particle size $d_{90}$ of about 23 mm.

The surface layer (SL) particles had a particle size $d_{50}$ of about 7.5 mm and a particle size $d_{90}$ of about 16 mm.

Group A particles and Group B particles were processed separately:

A) The obtained wood particles were mixed in a blender with paddle mixer with 8.5 parts by weight (d/d), based on the total dry weight of wood particles, with an urea-formaldehyde binder (Kaurit 350 of BASF AG, Germany), together with 1.5 parts by weight (d/d), based on the total dry weight of wood particles of ammonium nitrate (40% solution) as hardener.

B) The obtained wood particles were mixed in a blender with paddle mixer with 12 parts by weight (d/d), based on the total dry weight of wood particles, with an urea-formaldehyde binder (Kaurit 350 of BASF AG, Germany), together with 0.5 parts by weight (d/d), based on the total dry weight of wood particles of ammonium nitrate (40% solution) as hardener.

The resin impregnated wood particles were then formed into a mat consisting of three layers with a distribution of 1. Wood particles from group B) with spread in height of 25% of the total height of the spread wood particle mat
2. Wood particle from group A) with spread in a height of 50% of the total height of the spread wood particle mat
3. Wood particles from group B) with spread in height of 25% of the total height of the spread wood particle mat The obtained mat was prepressed at room temperature. The prepressed mat was then hot pressed into a solid board of 17.5 mm thickness at a temperature of 220° C.±2° C. with a pressing time factor of 15 s/mm. The obtained board was then sanded to a thickness of 17 mm.

b) Inventive Particle Boards

If not described otherwise, the inventive particle boards were prepared as described for the comparative particle board above.

In contrast to the comparative particle board, the inventive particle board is characterized in that fibres in an amount of 10 parts by weight (d/d), based on the total dry weight of wood particles in group A) of the comparative sample, respectively, or 10 parts by weight (d/d), based on the total dry weight of wood particles in group B) of the comparative sample, respectively, or 10 parts by weight (d/d), based on the total dry weight of wood particles in group A) and B) of the comparative sample, respectively, were replaced by calcium carbonate containing material in an amount of 10 parts by weight (d/d), based on the total dry weight of wood particles in group A) of the comparative sample, respectively, or 10 parts by weight (d/d), based on the total dry weight of wood particles in group B) of the comparative sample, respectively, or 10 parts by weight (d/d), based on the total dry weight of wood particles in group A) and B) of the comparative sample, respectively. Thus, the wood particle-calcium carbonate-containing material mixture used for preparing the inventive particle board consist of 90.0 parts by weight (d/d) of wood particles and 10 parts by weight (d/d) of the calcium carbonate-containing material, based on the total dry weight of the wood particles in group A), respectively, or the wood particle-calcium carbonate-containing material mixture used for preparing the inventive particle board consist of 90.0 parts by weight (d/d) of wood particles and 10 parts by weight (d/d) of the calcium carbonate-containing material, based on the total dry weight of the wood particles in group B), respectively, or the wood particle-calcium carbonate-containing material mixture used for preparing the inventive particle board consist of 90.0 parts by weight (d/d) of wood particles and 10 parts by weight (d/d) of the calcium carbonate-containing material, based on the total dry weight of the wood particles in groups A) and B) based on the total dry weight of the wood particles and the at least one particulate calcium carbonate-containing material.

The details regarding the wood particle replacement content for the comparative and inventive particle boards are summarized in Table 1.

TABLE 1

Wood particle replacement content for the comparative particle board (CE) and inventive particle boards 1 to 7 (IE1 to IE7)

| | Reference (CE) | IE 1 10 pbw WPR in SL by $CaCO_3$ | IE 2 10 pbw WPR in ML by $CaCO_3$ | IE 3 10 pbw WPR in SL by $CaCO_3$ | IE 4 10 pbw WPR in ML by $CaCO_3$ | IE 5 10 pbw WPR in SL by $CaCO_3$ | IE 6 10 pbw WPR in ML by $CaCO_3$ | IE 7 10 pbw WPR in SL and ML by $CaCO_3$ |
|---|---|---|---|---|---|---|---|---|
| Wood Particles [pbw] | 100 | 95 | 95 | 95 | 95 | 95 | 95 | 90 |
| $CaCO_3$ A [pbw] | — | 5 | 5 | — | — | — | — | — |
| $CaCO_3$ B [pbw] | — | — | — | 5 | 5 | — | — | 10 |
| $CaCO_3$ C [pbw] | — | — | — | — | — | 5 | 5 | — |
| Σ | 100 | 100 | 100 | 100 | 100 | 100 | 100 | 100 |

SL: surface layer
ML: middle layer
WPR: wood particle replacement
pbw: parts by weight
This table reflects the overall replacement of wood particles with respect to the whole particle board The results are outlined in FIGS. 1 to 4.

From FIGS. 1 to 4 it can be gathered that the replacement of wood particles by the calcium carbonate-containing material leads to particle boards having mechanical properties which are maintained or even improved compared to the comparative particle board. In particular, it is shown that a particle board in which 10 parts by weight (d/d) of wood particles were replaced by $CaCO_3$ C shows clearly less thickness swelling than the comparative particle board. Furthermore, the equilibrium moisture of the particle boards is reduced when the amount of $CaCO_3$ in the particle boards in increased which thus decreases the overall weight of the particle board. Furthermore the internal bond strength and the bending strength properties can be maintained compared to the comparative sample. All other parameters are the same as for the comparative sample.

Test 2

This test shows the influence of the replacement of wood particles with a calcium carbonate-containing material with respect to the mean particle size and particle size distribution, on mechanical properties of a particle board.

a) Comparative Particle Board

The comparative particle-board (CE) is characterized in that the board only comprises wood particles, i.e. wood particles are not replaced by a calcium carbonate containing material.

The wood particles used were from industrial production and included a mixture of wood species (pine, spruce etc.) and had their origin in primary wood sources (round wood) or secondary wood sources (saw mill by products, wood chips, recycled wood etc.). The wood particles are classified in two groups: A) wood particles for the middle layer and B) wood particles for the surface layer.

The middle layer (ML) particles had a particle size $d_{50}$ of about 9 mm and a particle size $d_{90}$ of about 23 mm.

The surface layer (SL) particles had a particle size $d_{50}$ of about 7.5 mm and a particle size $d_{90}$ of about 16 mm.

Group A particles and Group B particles were processed separately:

A) The obtained wood particles were mixed in a blender with paddle mixer with 8.5 parts by weight (d/d), based on the total dry weight of wood particles, with an urea-formaldehyde binder (Kaurit 350 of BASF AG, Germany), together with 1.5 parts by weight (d/d), based on the total dry weight of wood particles of ammonium nitrate (40% solution) as hardener.

B) The obtained wood particles were mixed in a blender with paddle mixer with 12 parts by weight (d/d), based on the total dry weight of wood particles, with an urea-formaldehyde binder (Kaurit 350 of BASF AG, Germany), together with 0.5 parts by weight (d/d), based on the total dry weight of wood particles of ammonium nitrate (40% solution) as hardener.

The resin impregnated wood particles were then formed into a mat consisting of three layers with a distribution of 1. Wood particles from group B) with spread in height of 25% of the total height of the spread wood particle mat
2. Wood particles from group A) with spread in a height of 50% of the total height of the spread wood particle mat
3. Wood particles from group B) with spread in height of 25% of the total height of the spread wood particle mat The obtained mat was prepressed at room temperature. The prepressed mat was then hot pressed into a solid board of 17.5 mm thickness at a temperature of 220° C.±2° C. with a pressing time factor of 15 s/mm. The obtained board was then sanded to a thickness of 17 mm.

b) Inventive Particle Boards

If not described otherwise, the inventive particle boards were prepared as described for the comparative particle board above.

In contrast to the comparative particle board, the inventive particle board is characterized in that fibres in an amount of 20 parts by weight (d/d), 30 parts by weight (d/d), 40 parts by weight (d/d), based on the total dry weight of wood particles in wood particle group A) of the comparative sample, respectively, or 20 parts by weight (d/d), 30 parts by weight (d/d), 40 parts by weight (d/d), based on the total dry weight of wood particles in wood particle group B) of the comparative sample, respectively, or 10 parts by weight (d/d), 20 parts by weight (d/d), 30 parts by weight (d/d), based on the total dry weight of wood particles in group A) and B) of the comparative sample, respectively, were replaced by calcium carbonate containing material in an amount of 20 parts by weight (d/d), 30 parts by weight (d/d), 40 parts by weight (d/d), based on the total dry weight of wood particles in group A) of the comparative sample, respectively, or 20 parts by weight (d/d), 30 parts by weight (d/d), 40 parts by weight (d/d), based on the total dry weight of wood particles in group B) of the comparative sample, respectively, or 10 parts by weight (d/d), 20 parts by weight (d/d), 30 parts by weight (d/d), based on the total dry weight of wood particles in group A) and B) of the comparative sample, respectively. Thus, the wood particle-calcium carbonate-containing material mixture used for preparing the inventive particle board consist of 80.0 parts by weight (d/d) of wood particles and 20 parts by weight (d/d) of the calcium carbonate-containing material, based on the total dry weight of the wood particles in group A), respectively, 70.0 parts by weight (d/d) of wood particles and 30 parts by weight (d/d) of the calcium carbonate-containing material, based on the total dry weight of the wood particles in group A), respectively, 60 parts by weight (d/d) of wood particles and 40 parts by weight (d/d) of the calcium carbonate-containing material, based on the total dry weight of the wood particles in group A), respectively, or the wood particle-calcium carbonate-containing material mixture used for preparing the inventive particle board consist of 80.0 parts by weight (d/d) of wood particles and 20 parts by weight (d/d) of the calcium carbonate-containing material, based on the total dry weight of the wood particles in group B), respectively, 70.0 parts by weight (d/d) of wood particles and 30 parts by weight (d/d) of the calcium carbonate-containing material, based on the total dry weight of the wood particles in group B), respectively, 60 parts by weight (d/d) of wood particles and 40 parts by weight (d/d) of the calcium carbonate-containing material, based on the total dry weight of the wood particles in group B) respectively, or 90.0 parts by weight (d/d) of wood particles and 10 parts by weight (d/d) of the calcium carbonate-containing material, based on the total dry weight of the wood particles in group A) and B), respectively, 80.0 parts by weight (d/d) of wood particles and 20 parts by weight (d/d) of the calcium carbonate-containing material, based on the total dry weight of the wood particles in group A) and B), respectively, 70 parts by weight (d/d) of wood particles and 30 parts by weight (d/d) of the calcium carbonate-containing material, based on the total dry weight of the wood particles in group A) and B), based on the total dry weight of the wood particles and the at least one particulate calcium carbonate-containing material.

The calcium carbonate used was calcium carbonate C.

The details regarding the wood particle replacement content for the comparative and inventive particle boards are summarized in Table 2.

Figure 5:
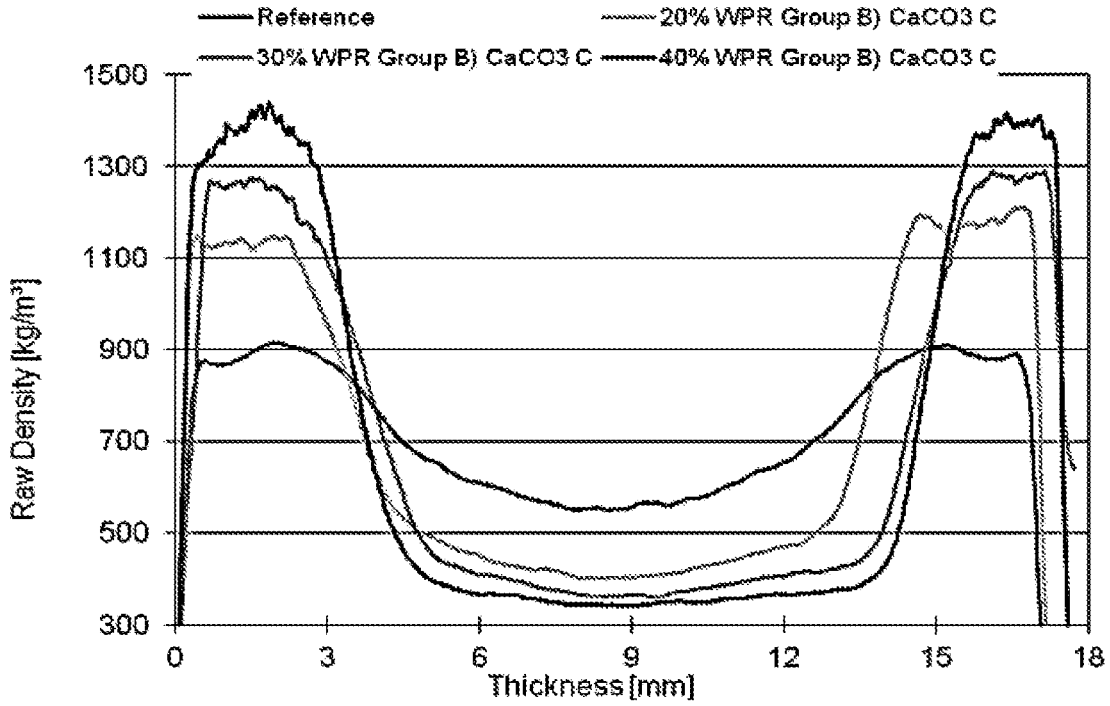
FIG. 5 shows the density versus thickness of particle boards with various wood particle replacement contents in accordance with the invention, and compares the same to a reference particle board.
Figure 6:
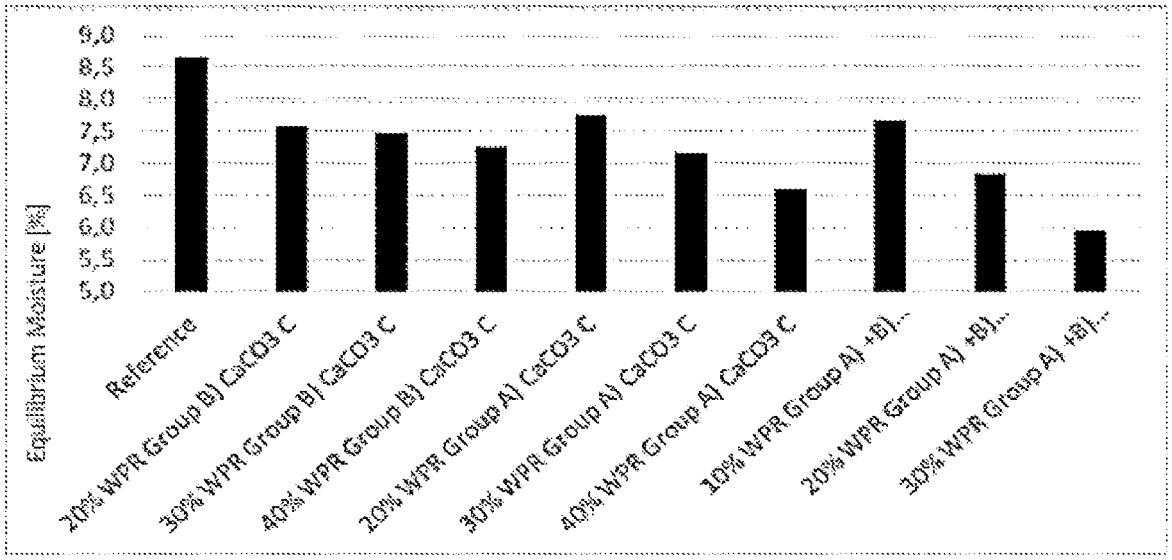
FIG. 6 shows the wood moisture content of particle boards with various wood particle replacement contents in accordance with the invention, in comparison to a reference particle board.

The results for the density and the equilibrium moisture are outlined in FIGS. 5 and 6.

From the obtained results it can be gathered that the replacement of wood particles by the calcium carbonate-containing material leads to particle boards having mechanical properties which are maintained or even improved compared to the comparative sample. In particular, the equilibrium moisture of the particle boards is reduced when the amount of $CaCO_3$ in the particle boards in increased which thus decreases the overall weight of the particle board. Furthermore, it is shown that a particle board in which 20 to 40 parts by weight (d/d) of wood particles of group B) were replaced by $CaCO_3$ C shows comparable internal bond values compared to the comparative sample. Furthermore, the bending strength, modulus of elasticity as well as thickness swelling can be maintained compared to the comparative sample and are well within the classifications of the European standard requirements according to DIN EN 312. All other parameters are the same as for the comparative sample.

Table 3 outlines the theoretically achieved classifications following European standard DIN EN 312.

TABLE 3

Theoretically achieved classifications following European standard DIN EN 312

| Sample | P1 | P2 | P3 | P4 | P5 | P6 |
|---|---|---|---|---|---|---|
| Reference (CE) | x | x | x | x | x | x |
| 10% WPR Group B) $CaCO_3$ C | x | x | x | x | x | x |
| 20% WPR Group B) $CaCO_3$ C | x | x | x | — | — | — |
| 30% WPR Group B) $CaCO_3$ C | x | x | — | — | — | — |
| 40% WPR Group B) $CaCO_3$ C | — | — | — | — | — | — |
| 10% WPR Group A) $CaCO_3$ C | x | x | x | x | x | x |
| 20% WPR Group A) $CaCO_3$ C | x | x | x | x | — | — |
| 30% WPR Group A) $CaCO_3$ C | x | x | — | — | — | — |
| 40% WPR Group A) $CaCO_3$ C | x | — | — | — | — | — |
| 10% WPR Group A) + B) $CaCO_3$ C | x | x | x | — | — | — |
| 20% WPR Group A) + B) $CaCO_3$ C | x | x | — | — | — | — |
| 30% WPR Group A) + B) $CaCO_3$ C | — | — | — | — | — | — |

Specification achieved:
X = Yes;
— = No

The invention claimed is:

1. Particle board comprising, a) a wood particle base layer having a first side and a reverse side, the wood particle base layer comprising wood particles in an amount from 60.0 to 97.5 parts by weight (d/d) and at least one particulate calcium car-

TABLE 2

Wood particle replacement content for the comparative particle board (CE) and inventive particle boards 8 to 16 (IE8 to IE16)

| | Reference (CE) | IE 8 20 pbw WPR in SL by $CaCO_3$ | IE 9 30 pbw WPR in SL by $CaCO_3$ | IE 10 40 pbw WPR in SL by $CaCO_3$ | IE 11 20 pbw WPR in ML by $CaCO_3$ | IE 12 30 pbw WPR in ML by $CaCO_3$ | IE 13 40 pbw WPR in ML by $CaCO_3$ | IE 14 10 pbw WPR in SL and ML by $CaCO_3$ | IE 15 20 pbw WPR in SL and ML by $CaCO_3$ | IE 16 30 pbw WPR in SL and ML by $CaCO_3$ |
|---|---|---|---|---|---|---|---|---|---|---|
| Wood Particles [pbw] | 100 | 90 | 85 | 80 | 90 | 85 | 80 | 90 | 80 | 70 |
| $CaCO_3$ C [pbw] | — | 10 | 15 | 20 | 10 | 15 | 20 | 10 | 20 | 30 |
| Σ | 100 | 100 | 100 | 100 | 100 | 100 | 100 | 100 | 100 | 100 |

SL: surface layer
ML: middle layer
WPR: wood particle replacement
pbw: parts by weight
This table reflects the overall replacement of wood particles with respect to the whole panel bonate-containing material in an amount from 2.5 to 40.0 parts by weight (d/d), based on the total dry weight of the wood particles and the at least one particulate calcium carbonate-containing material of the wood particle base layer, and b) at least one wood particle surface layer being in contact with the first side and/or the reverse side of the wood particle base layer, the at least one wood particle surface layer comprising wood particles in an amount from 70.0 to 97.5 parts by weight (d/d) and at least one particulate calcium carbonate-containing material in an amount from 2.5 to 30.0 parts by weight (d/d), based on the total dry weight of the wood particles and the at least one particulate calcium carbonate-containing material of the at least one wood particle surface layer, wherein the sum of the amount of the wood particles and the at least one particulate calcium carbonate-containing material in each of the wood particle base layer and the at least one wood particle surface layer is 100.0 parts by weight (d/d), based on the total dry weight of the wood particles and the at least one particulate calcium carbonate-containing material in each of the wood particle base layer and the at least one wood particle surface layer, and wherein the at least one particulate calcium carbonate-containing material in the wood particle base layer and/or the at least one wood particle surface layer is characterized in that the at least one particulate calcium carbonate-containing material has a weight median particle size $d_{50}$ from 1.0 μm to 1000.0 μm and consists of calcium carbonate in an amount of >95.0 wt.-% based on the total dry weight of the calcium carbonate-containing material.

2. Particle board according to claim 1, wherein the at least one particulate calcium carbonate-containing material is at least one ground calcium carbonate (GCC).

3. Particle board according to claim 1, wherein the at least one particulate calcium carbonate-containing material of the wood particle base layer and/or the at least one wood particle surface layer has a) a weight median particle size $d_{50}$ from 15.0 μm to 1 000.0 μm, and/or b) a specific surface area of ≤5.0 $m^2/g$, as measured by the BET nitrogen method, and/or c) a top cut $d_{98}$ from 100.0 to 1 200.0 μm.

4. Particle board according to claim 1, wherein the wood particles of the wood particle base layer and the at least one wood particle surface layer originate from primary wood sources or secondary wood sources.

5. Particle board according to claim 1, wherein the wood particle base layer comprises the wood particles in an amount from 70.0 to 95.0 parts by weight (d/d) and the at least one particulate calcium carbonate-containing material in an amount from 5.0 to 30.0 parts by weight (d/d), based on the total dry weight of the wood particles and the at least one particulate calcium carbonate-containing material of the wood particle base layer, and/or the at least one wood particle surface layer comprises the wood particles in an amount from 75.0 to 95.0 parts by weight (d/d) and at least one particulate calcium carbonate-containing material in an amount from 5.0 to 25.0 parts by weight (d/d), based on the total dry weight of the wood particles and the at least one particulate calcium carbonate-containing material of the at least one wood particle surface layer.

6. Particle board according to claim 1, wherein the wood particles of the wood particle base layer and of the at least one wood particle surface layer are the same or different; and/or the at least one particulate calcium carbonate-containing material of the wood particle base layer and of the at least one wood particle surface layer are the same or different.

7. Particle board according to claim 1, wherein the wood particle base layer and/or the at least one wood particle surface layer comprise(s) at least one binder in an amount from 0.05 to 25.0 parts by weight (d/d), based on the total dry weight of the wood particles and the at least one particulate calcium carbonate-containing material.

8. Particle board according to claim 1, wherein the wood particle base layer and/or the at least one wood particle surface layer further comprises at least one compound selected from the group consisting of waxes, colorants, a filler differing from the at least one particulate calcium carbonate-containing material, dispersants, biocides, hardener and flame retardants, wherein said the wood particle base layer and/or the at least one wood particle surface layer comprises less than 10.0 parts by weight (d/d) of said compound-based on the total dry weight of the wood particles and the at least one particulate calcium carbonate-containing material in the layer, of said at least one compound.

9. Particle board according to claim 1, wherein the particle board is a three-layer particle board consisting of the wood particle base layer and two wood particle surface layers.

10. Particle board according to claim 1, wherein the particle board has a bending strength of ≥10 $N/mm^2$; and/or a modulus of elasticity of ≥1 000 $N/mm^2$; and/or internal bond strength of ≥0.30 $N/mm^2$; and/or a thickness swelling after 24 h water storage of ≤15%.

11. Process for manufacturing a particle board according to claim 1, the process comprising the steps of:

a) providing wood particles, in dry form, b) providing at least one particulate calcium carbonate-containing material, c) optionally providing at least one binder, d) combining the wood particles of step a) simultaneously or separately in any order with the at least one particulate calcium carbonate-containing material of step b) and the optional at least one binder and/or at least one compound of step c) to form a wood particle-calcium carbonate-containing material mixture which is suitable to form a wood particle base layer mat, e) combining the wood particles of step a) simultaneously or separately in any order with the at least one particulate calcium carbonate-containing material of step b) and the optional at least one binder and/or at least one compound of step c) to form a wood particle-calcium carbonate-containing material mixture which is suitable to form at least one wood particle surface layer mat, f) forming a multi-layer mat of the wood particle-calcium carbonate-containing material mixtures obtained in steps d) and e), and g) pressing the multi-layer mat of step f) in one or more steps into a solid particle board.

12. Process according to claim 11, wherein process steps d) and/or e) is/are carried out in that the wood particles of step a) are combined simultaneously with the at least one particulate calcium carbonate-containing material of step b) and the optional at least one binder and/or at least one compound of step c), or process steps d) and/or e) is/are carried out in that the wood particles of step a) are combined separately with the at least one particulate calcium carbonate-containing material of step b) and the optional at least one binder and/or at least one compound of step c).

13. Process according to claim 11, wherein the wood particles of step a) and/or the at least one particulate calcium carbonate-containing material of step b) is/are provided in dry form.

14. Particle board according to claim 1, wherein the particle board has a thickness from 0.2 to 300.0 mm.

15. Particle board according to claim 1, wherein the wood particle base layer has a thickness from 0.1 to 150.0 mm, and/or the at least one wood particle surface layer has a thickness from 0.1 to 150.0 mm.

16. Particle board according to claim 1, wherein the at least one particulate calcium carbonate-containing material of the wood particle base layer and/or the at least one wood particle surface layer consists of calcium carbonate in an amount of ≥97.0 wt.-%, based on the total dry weight of the calcium carbonate-containing material.

17. Particle board according to claim 2, wherein the at least one ground calcium carbonate (GCC) is selected from the group consisting of marble, chalk, limestone, and mixtures thereof.

18. Particle board according to claim 6, wherein the at least one particulate calcium carbonate-containing material of the wood particle base layer and of the at least one wood particle surface layer differ in their weight median particle size $d_{50}$.

19. Particle board according to claim 6 wherein the at least one binder is selected from the group consisting of phenol-formaldehyde resin (PF), urea-formaldehyde resin (UF), melamine-formaldehyde resin (MF), melamine-urea-formaldehyde resin (MUF), urea-melamine-formaldehyde resin (UMF), urea-melamine-phenol-formaldehyde resin (UMPF), epoxy resin, methylene diphenyl diisocyanate resin (MDI), polyurethane resin (PU), resorcin resin, starch, carboxymethylcellulose and mixtures thereof.

* * * * *